US010645480B2

(12) United States Patent
Jo et al.

(10) Patent No.: US 10,645,480 B2
(45) Date of Patent: May 5, 2020

(54) ELECTRONIC APPARATUS AND METHOD FOR CONTROLLING TIME MEASUREMENT

(71) Applicant: Samsung Electronics Co., Ltd., Gyeonggi-do (KR)

(72) Inventors: Jae-Hyun Jo, Gyeonggi-do (KR); Jungsu Kim, Gyeonggi-do (KR); Byoung-Chul Lee, Gyeonggi-do (KR); Seunguk Jang, Gyeonggi-do (KR); Donghoon Hyun, Gyeonggi-do (KR); Ilsung Hong, Seoul (KR); Donghyoun Son, Gyeonggi-do (KR); Sang-Hyeok Sim, Gyeonggi-do (KR); Gwangho Hwang, Daegu (KR); Kyukang Lee, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 2 days.

(21) Appl. No.: 16/159,200

(22) Filed: Oct. 12, 2018

(65) Prior Publication Data

US 2019/0124433 A1 Apr. 25, 2019

(30) Foreign Application Priority Data

Oct. 24, 2017 (KR) ..... 10-2017-0138183

(51) Int. Cl.
*H04R 1/10* (2006.01)
*H04R 29/00* (2006.01)

(52) U.S. Cl.
CPC ..... *H04R 1/1025* (2013.01); *H04R 1/1016* (2013.01); *H04R 2420/07* (2013.01)

(58) Field of Classification Search
CPC .. H02J 50/00; H02J 50/05; H02J 50/10; H02J 50/20; H02J 50/80; H02J 17/00; H04R 1/1025; H04R 1/1016
(Continued)

(56) References Cited

U.S. PATENT DOCUMENTS 5,216,357 A 6/1993 Coppola et al.
2009/0252344 A1 10/2009 Mao et al.
(Continued)

FOREIGN PATENT DOCUMENTS

KR 1020050089927 9/2005
KR 1020090129597 12/2009
(Continued)

OTHER PUBLICATIONS

International Search Report dated Jan. 22, 2019 issued in counterpart application No. PCT/KR2018/011867, 8 pages.

*Primary Examiner* — Ammar T Hamid
(74) *Attorney, Agent, or Firm* — The Farrell Law Firm, P.C.

(57) ABSTRACT

An electronic device and method for operating the same. The electronic device includes a communication interface; a rechargeable; a timer; a first processor operably coupled to the communication interface, battery, and timer; and a second processor operably coupled to the battery, wherein the first processor is configured to receive, from an external electronic device, information associated with time; while remaining capacity of the battery is greater than or equal to a reference value, obtain, by using the timer, first information associated with time that is elapsed since the information is received; and in response to identifying that the remaining capacity is less than the reference value, switch a state of the second processor to an active state, and wherein the second processor is configured to obtain second information associated with time that is elapsed since the second processor is switched to the active state; and in response to detecting that the electronic device is connected to another electronic device for recharging the battery, provide the second information to the first processor.

20 Claims, 16 Drawing Sheets

(58) Field of Classification Search
USPC ..... 381/74, 58; 455/573
See application file for complete search history.

(56) References Cited

U.S. PATENT DOCUMENTS

| | | | | |
|---|---|---|---|---|
| 2015/0181531 | A1* | 6/2015 | Zajac | G06F 1/3212 455/574 |
| 2017/0164089 | A1 | 6/2017 | Lee et al. | |
| 2017/0192743 | A1 | 7/2017 | Chun et al. | |
| 2017/0302090 | A1 | 10/2017 | Han | |

FOREIGN PATENT DOCUMENTS

| | | |
|---|---|---|
| KR | 1020160085844 | 7/2016 |
| KR | 10-2017-0067050 | 6/2017 |
| KR | 10-2017-0082405 | 7/2017 |

* cited by examiner

ELECTRONIC APPARATUS AND METHOD FOR CONTROLLING TIME MEASUREMENT

CROSS-REFERENCE TO RELATED APPLICATION(S)

This application is based on and claims priority under 35 U.S.C. § 119 to Korean Patent Application No. 10-2017-0138183, filed on Oct. 24, 2017 in the Korean Intellectual Property Office, the disclosure of which is incorporated by reference herein in its entirety.

BACKGROUND

1. Field

The present disclosure relates generally to an electronic device and a method for controlling time measurement, and more particularly, to an electronic device and a method for controlling time measurement using a processor which operates with lower power than steady state power.

2. Description of the Related Art

With development of technology, an electronic device which outputs audio based on data received in wireless communication is under development. Such an electronic device, which is attachable to part (e.g., an ear) of a user's body, may be referred to as a wearable device.

An electronic device which outputs audio based on data received in a wireless communication, which is attachable to part of a user's body, may provide different functions such as biometric information collection, a notification provision, and an indication provision. To provide such functions, the electronic device may measure time.

In addition, for mobility, an electronic device may include a rechargeable battery. Since a battery has limited capacity, a solution for measuring time in a low power state may be required in an electronic device.

SUMMARY

An aspect of the present disclosure provides an electronic device and a method for controlling time measurement using a processor which operates with lower power than steady state power.

According to an aspect of the present disclosure, an electronic device is provided. The electronic device includes a communication interface; a battery configured to be rechargeable; a timer; a first processor operably coupled to the communication interface, the battery, and the timer; and a second processor operably coupled to the battery, wherein the first processor is configured to receive, from an external electronic device, information associated with time; while remaining capacity of the battery is greater than or equal to a reference value, obtain, by using the timer, first information associated with time that is elapsed since the information is received; and in response to identifying that the remaining capacity is less than the reference value, switch a state of the second processor to an active state, and wherein the second processor is configured to obtain second information associated with time that is elapsed since the second processor is switched to the active state; and in response to detecting that the electronic device is connected to another electronic device for recharging the battery, provide the second information to the first processor.

According to another aspect of the present disclosure, an electronic device is provided. The electronic device includes an interface, time measurement circuitry, and a processor operably coupled to the interface and the time measurement circuitry, wherein the processor is configured to receive, via the interface from an external electronic device connected to the electronic device, a message for indicating that a battery of the external electronic device is fully charged, identify whether the electronic device is obtaining power externally, based on identifying that the electronic device is obtaining the power, transmit a signal for activating a processor of the external electronic device that is associated with a timer of the external electronic device to the external electronic device, and based on identifying that the electronic device is not obtaining the power, measure time by using the time measurement circuitry and transmit information regarding the measured time to the external electronic device.

According to another aspect of the present disclosure, a method for operating an electronic device is provided. The method includes receiving, by a first processor of the electronic device, information associated with time, from an external electronic device, while remaining capacity of the battery is greater than or equal to a reference value, obtaining, by the first processor, first information associated with time that is elapsed since the information is received, by using a timer of the electronic device, and, in response to identifying that the remaining capacity is less than the reference value, switching, by the first processor, a state of the second processor to an active state, obtaining, by a second processor of the electronic device, second information associated with time that is elapsed since the second processor is switched to the active state, and, in response to detecting that the electronic device is connected to another electronic device for recharging the battery, providing, by the second processor, the second information to the first processor.

According to another aspect of the present disclosure, a method for operating an electronic device is provided. The method includes receiving, via an interface from an external electronic device connected to the electronic device, a message for indicating that a battery of the external electronic device is fully charged, identifying whether the electronic device is obtaining power externally, based on identifying that the electronic device is obtaining the power, transmitting a signal for activating a processor of the external electronic device that is associated with a timer of the external electronic device to the external electronic device, and, based on identifying that the electronic device is not obtaining the power, measuring time by using time measurement circuitry of the electronic device and transmitting information regarding the measured time to the external electronic device.

BRIEF DESCRIPTION OF THE DRAWINGS

The above and other aspects, features, and advantages of certain embodiments of the present disclosure will be more apparent from the following description, taken in conjunction with the accompanying drawings, in which.

DETAILED DESCRIPTION

Figure 1:
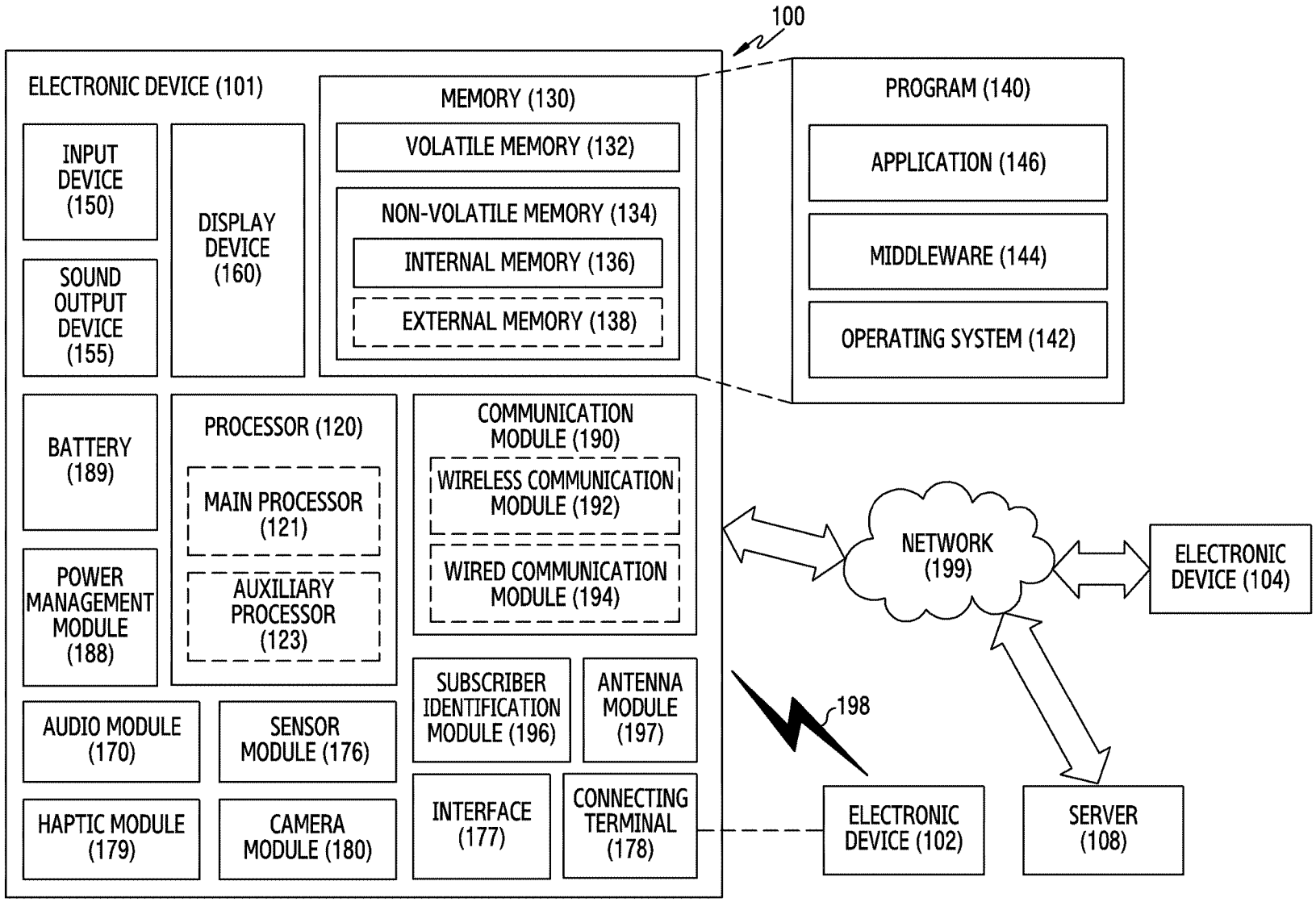
FIG. 1 is a block diagram of an electronic device in a network environment, for controlling time measurement, according to an embodiment.

FIG. 1 is a block diagram of an electronic device 101 in a network environment 100 according to an embodiment.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. The electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing a record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, the hologram device, and the projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 and may be physically connected with the external electronic device (e.g., the electronic device 102). According to an embodiment, the connecting terminal 178 may include, for example, an HDMI connector, a USB connector, an SD card connector, or an audio connector (e.g., a headphone connector).

The haptic module 179 may convert an electrical signal into a mechanical stimulus (e.g., a vibration or a movement) or an electrical stimulus which may be recognized by a user via a tactile sensation or a kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. According to an embodiment, the communication module 190 may include a wireless communication module 192 (e.g., a cellular communication module, a short-range wireless communication module, a global navigation satellite system (GNSS) communication module), a wired communication module 194 (e.g., a local area network (LAN) communication module, or a power line communication (PLC) module). A corresponding one of these communication modules may communicate with the external electronic device via the first network 198 (e.g., a short-range communication network, such as Bluetooth®, wireless-fidelity (Wi-Fi) direct, or an Infrared Data Association (IrDA) standard), or the second network 199 (e.g., a long-range communication network, such as a cellular network, the Internet, or a computer network (e.g., a LAN or a wide area network (WAN)). These various types of communication modules may be implemented as a single component (e.g., a single integrated circuit or chip), or may be implemented as multiple components (e.g., multiple chips) separate from each other. The wireless communication module 192 may identify and authenticate the electronic device 101 in a communication network, such as the first network 198 or the second network 199, using subscriber information (e.g., an international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., a printed circuit board (PCB)). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, a general purpose input and output (GPIO), a serial peripheral interface (SPI), or a mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type from, the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performance to the electronic device 101. The electronic device 101 may provide the outcome, with or without further processing of the outcome, as at least part of a reply to the request. To that end, a cloud computing, distributed computing, or client-server computing technology may be used, for example.

Figure 2:
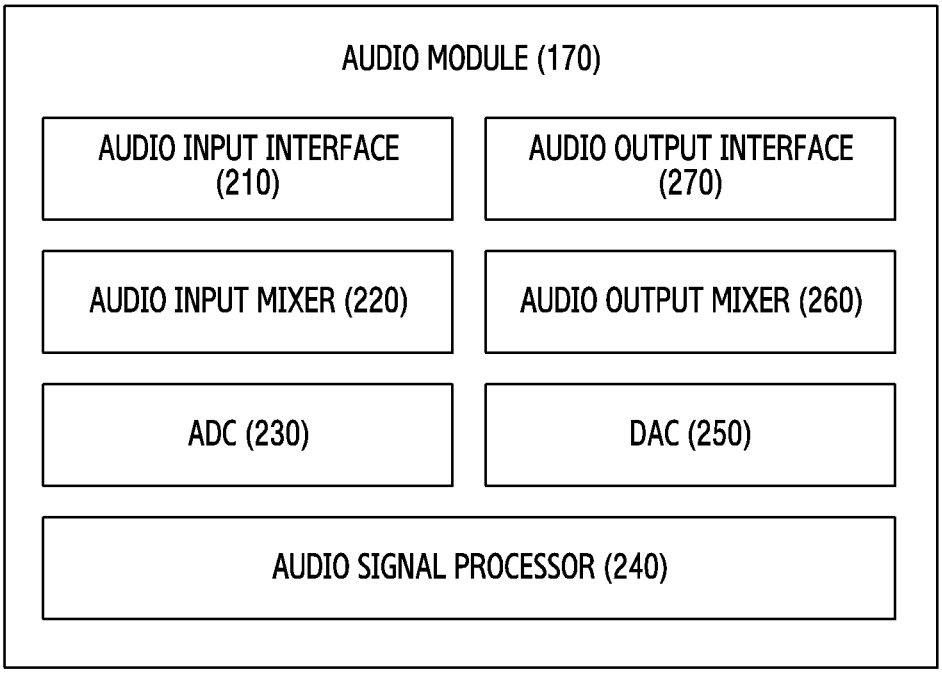
FIG. 2 is a block diagram of an audio module for controlling time measurement according to an embodiment.

FIG. 2 is a block diagram of the audio module 170 according to an embodiment.

Referring to FIG. 2, the audio module 170 may include, for example, an audio input interface 210, an audio input mixer 220, an analog-to-digital converter (ADC) 230, an audio signal processor 240, a digital-to-analog converter (DAC) 250, an audio output mixer 260, or an audio output interface 270.

The audio input interface 210 may receive an audio signal corresponding to a sound obtained from the outside of the electronic device 101 via a microphone (e.g., a dynamic microphone, a condenser microphone, or a piezo microphone) that is configured as part of the input device 150 or separately from the electronic device 101. For example, if an audio signal is obtained from the external electronic device 102 (e.g., a headset or a microphone), the audio input interface 210 may be connected with the external electronic device 102 directly via the connecting terminal 178, or wirelessly (e.g., Bluetooth® communication) via the wireless communication module 192 to receive the audio signal. According to an embodiment, the audio input interface 210 may receive a control signal (e.g., a volume adjustment signal received via an input button) related to the audio signal obtained from the external electronic device 102. The audio input interface 210 may include a plurality of audio input channels and may receive a different audio signal via a corresponding one of the plurality of audio input channels, respectively. Additionally or alternatively, the audio input interface 210 may receive an audio signal from another component (e.g., the processor 120 or the memory 130) of the electronic device 101.

The audio input mixer 220 may synthesize a plurality of inputted audio signals into at least one audio signal. For example, according to an embodiment, the audio input mixer 220 may synthesize a plurality of analog audio signals inputted via the audio input interface 210 into at least one analog audio signal.

The ADC 230 may convert an analog audio signal into a digital audio signal. For example, according to an embodiment, the ADC 230 may convert an analog audio signal received via the audio input interface 210 or, additionally or alternatively, an analog audio signal synthesized via the audio input mixer 220 into a digital audio signal.

The audio signal processor 240 may perform various processing on a digital audio signal received via the ADC 230 or a digital audio signal received from another component of the electronic device 101. For example, according to an embodiment, the audio signal processor 240 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. One or more functions of the audio signal processor 240 may be implemented in the form of an equalizer.

The DAC 250 may convert a digital audio signal into an analog audio signal. For example, according to an embodiment, the DAC 250 may convert a digital audio signal processed by the audio signal processor 240 or a digital audio signal obtained from another component (e.g., the processor (120) or the memory (130)) of the electronic device 101 into an analog audio signal.

The audio output mixer 260 may synthesize a plurality of audio signals, which are to be outputted, into at least one audio signal. For example, according to an embodiment, the audio output mixer 260 may synthesize an analog audio signal converted by the DAC 250 and another analog audio signal (e.g., an analog audio signal received via the audio input interface 210) into at least one analog audio signal.

The audio output interface 270 may output an analog audio signal converted by the DAC 250 or, additionally or alternatively, an analog audio signal synthesized by the audio output mixer 260 to the outside of the electronic device 101 via the sound output device 155. The sound output device 155 may include, for example, a speaker, such as a dynamic driver or a balanced armature driver, or a receiver. According to an embodiment, the sound output device 155 may include a plurality of speakers. In such a case, the audio output interface 270 may output audio signals having a plurality of different channels (e.g., stereo channels or 5.1 channels) via at least some of the plurality of speakers. The audio output interface 270 may be connected with the external electronic device 102 (e.g., an external speaker or a headset) directly via the connecting terminal 178 or wirelessly via the wireless communication module 192 to output an audio signal.

According to an embodiment, the audio module 170 may generate, without separately including the audio input mixer 220 or the audio output mixer 260, at least one digital audio signal by synthesizing a plurality of digital audio signals using at least one function of the audio signal processor 240.

According to an embodiment, the audio module 170 may include an audio amplifier (e.g., a speaker amplifying circuit) that is capable of amplifying an analog audio signal inputted via the audio input interface 210 or an audio signal that is to be outputted via the audio output interface 270. The audio amplifier may be configured as a module separate from the audio module 170.

Figure 3:
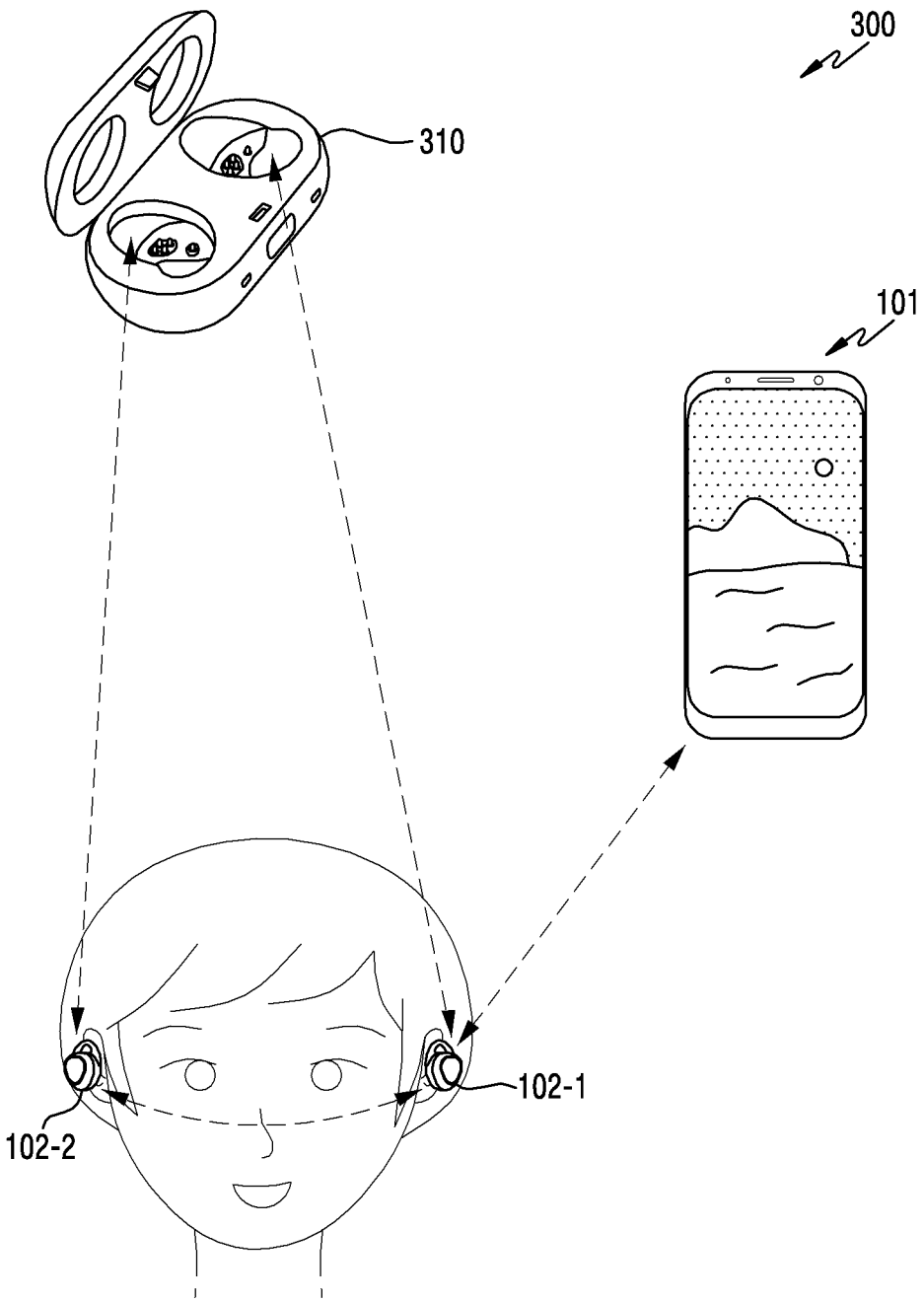
FIG. 3 is an illustration of an environment including electronic devices according to an embodiment.

FIG. 3 is an illustration of an environment 300 including electronic devices according to an embodiment. Such an environment may include the electronic device 101 and the electronic device 102 of FIG. 1.

Referring to FIG. 3, the environment 300 may include an electronic device 101, an electronic device 102-1, an electronic device 102-2, and a charger 310.

The electronic device 101 may output audio. The electronic device 101 may output the audio in association with one or more of the electronic device 102-1 or the electronic device 102-2.

In an embodiment, to output audio through one or more of the electronic device 102-1 or the electronic device 102-2, the electronic device 101 may transmit data to one or more of the electronic device 102-1 or the electronic device 102-2. For the data transmission, the electronic device 101 may generate a communication path between the electronic device 101 and the electronic device 102-1 and/or a communication path between the electronic device 101 and the electronic device 102-2. The communication path may be generated based on various communication schemes. For example, the communication path may include one or more of a path for the Bluetooth® communication scheme, a path for a Bluetooth® low energy (BLE) communication scheme, a path for the Wi-Fi direct communication scheme, or a path for a mobile communication scheme (e.g., long term evolution (LTE) side link). To output the audio from one or more of the electronic device 102-1 or the electronic device 102-2, the electronic device 101 may transmit data to one or more of the electronic device 102-1 or the electronic device 102-2 in the generated communication path.

In an embodiment, the electronic device 101 may generate the communication path with any one of the electronic device 102-1 and the electronic device 102-2. For example, the electronic device 101 may be connected with the electronic device 102-1, among the electronic device 102-1 and the electronic device 102-2. If the electronic device 101 is connected with the electronic device 102-1, the electronic device 101 or the electronic device 102-1 may provide the electronic device 102-2 with communication path information of the electronic device 101 and the electronic device 102-1, wherein the electronic device 102-2 may output the audio. Based on the communication path information, the electronic device 102-2 may receive or sniff data transmitted to the electronic device 102-1 in the communication path. Based on the sniffed data, the electronic device 102-2 may output the data. If the electronic device 101 is connected with the electronic device 102-1, the electronic device 102-1 connected with the electronic device 101 may be referred to as a master device and the electronic device 102-2 not connected with the electronic device 101 may be referred to as a slave device. For example, the electronic device 102-1 is configured as the master device and the electronic device 102-2 is configured as the slave device. The electronic device 101 according to an embodiment may be connected with the electronic device 102-2 and may not be connected with the electronic device 102-1, for the audio output.

In an embodiment, to store a sound source in one or more of the electronic device 102-1 or the electronic device 102-2, the electronic device 101 may transmit sound source information. For example, the electronic device 101 may transmit the sound source information, wherein one or more of the electronic device 102-1 or the electronic device 102-2 may independently output the audio without association with the electronic device 101. The sound source information may be configured with at least one sound file or playlist.

In an embodiment, the electronic device 101 may transmit time information to one or more of the electronic device 102-1 or the electronic device 102-2. For example, the time may be local time corresponding to a location of the electronic device 101.

In an embodiment, the electronic device 101 may receive data from one or more of the electronic device 102-1 or the electronic device 102-2. For example, the data may include information (e.g., information for playing the sound source, information for pausing the sound source, information for stopping the sound source, information for controlling (e.g., volume up, volume down) a sound volume, information for selecting a sound source, etc.) for controlling the audio which is outputted through one or more of the electronic device 102-1 or the electronic device 102-2. For example, the data may include information obtained through one or more of the electronic device 102-1 or the electronic device 102-2. For example, the data may include a user's biometric information such as user heart rate information or the user's exercise log. The electronic device 101 may receive the data from one or more of the electronic device 102-1 or the electronic device 102-2 in the communication path.

In an embodiment, the electronic device 101 may display a screen associated with one or more of the electronic device 102-1 or the electronic device 102-2. For example, the electronic device 101 may display a screen for controlling the audio which is outputted through one or more of the electronic device 102-1 or the electronic device 102-2. For example, the electronic device 101 may display a screen including data obtained by one or more of the electronic device 102-1 or the electronic device 102-2. The screen may include exercise log information of a user who wears the electronic device 102-1 or the electronic device 102-2, and the user's heat rate information.

The electronic device 101 of FIG. 3 may correspond to the electronic device 101 of FIG. 1.

The electronic device 102-1 and the electronic device 102-2 may each output the audio. The electronic device 102-1 and the electronic device 102-2 may each output the audio through their output device (e.g., a driver unit, a speaker, etc.).

In an embodiment, one or more of the electronic device 102-1 and the electronic device 102-2 may output the audio based on data received from the electronic device 101. For example, one or more of the electronic device 102-1 and the electronic device 102-2 may output the audio based on data received from the electronic device 101 in the communication path.

In an embodiment, if the electronic device 101 is connected with the electronic device 102-1 among the electronic device 102-1 and the electronic device 102-2 (i.e., if the electronic device 102-1 is configured as the master device and the electronic device 102-2 is configured as the slave device), the electronic device 102-1 may output the audio based on data received from the electronic device 101 in the communication path and the electronic device 102-2 may output the audio by sniffing the data received at the electronic device 102-1 from the electronic device 101 in the communication path.

In an embodiment, if the electronic device 101 is connected with the electronic device 102-1 among the electronic device 102-1 and the electronic device 102-2 (i.e., if the electronic device 102-1 is configured as the master device and the electronic device 102-2 is configured as the slave device), the electronic device 102-2 may receive from the electronic device 102-1, the data received at the electronic device 102-1 from the electronic device 101 in the communication path. In this case, the electronic device 102-1 may generate a communication path between the electronic device 102-1 and the electronic device 102-2. The electronic device 102-2 may receive from the electronic device 102-1, the data provided from the electronic device 101 to the electronic device 102-1, in the communication path between the electronic device 102-1 and the electronic device 102-2. The electronic device 102-2 may output the audio based on the data.

In an embodiment, one or more of the electronic device 102-1 or the electronic device 102-2 may measure time. One or more of the electronic device 102-1 or the electronic device 102-2 may obtain time information.

In an embodiment, one or more of the electronic device 102-1 and the electronic device 102-2 may output the audio independently from the electronic device 101. For example, one or more of the electronic device 102-1 and the electronic device 102-2 may store at least one sound file or at least one playlist. Based on the stored at least one sound file or the stored at least one playlist, the one or more of the electronic device 102-1 and the electronic device 102-2 may output the audio without association with the electronic device 101.

One or more of the electronic device 102-1 and the electronic device 102-2 may transmit data for controlling the outputted audio, to the electronic device 101.

The electronic device 102-1 and the electronic device 102-2 may each be configured to be attachable to a part of a user's body. For example, the electronic device 102-1 may be attached to one ear of the user and the electronic device 102-2 may be attached to the other ear of the user.

One or more of the electronic device 102-1 or the electronic device 102-2 may obtain the biometric information through a sensor. For example, one or more of the electronic device 102-1 or the electronic device 102-2, which is attached to a part of the user's body, may obtain the user's biometric information such as the user's heart rate information or the user's exercise log information.

One or more of the electronic device 102-1 or the electronic device 102-2 may transmit or provide the obtained biometric information to other electronic device such as the electronic device 101.

The electronic device 102-1 and the electronic device 102-2 may each include a rechargeable battery for the sake of mobility. The battery may be charged by wireless or by wire. In an embodiment, for the battery charging, the electronic device 102-1 and the electronic device 102-2 may each be attached to a charger 310. The electronic device 102-1 and the electronic device 102-2 may each be physically attached to the charger 310 through a connector (e.g., a connector including one or more of a charging pin or a detecting pin) of the electronic device 102-1 and the electronic device 102-2 and a connector (e.g., a connector including one or more of a charging pad corresponding to the charging pin or a detecting pad corresponding to the detecting pin) of the charger 310. For wireless charging, the electronic device 102-1 and the electronic device 102-2 may each be positioned from the charger 310 within a distance configured for the wireless charging. The electronic device 102-1 and the electronic device 102-2 each electrically connected with the charger 310 may charge the battery based on power (or voltage) obtained from the charger 310.

The electronic device 102-1 and the electronic device 102-2 may each transmit information through an electrical connection with the charger 310. For example, the electronic device 102-1 and the electronic device 102-2 may each request the charger 310 to transmit information obtained by the charger 310.

The electronic device 102-1 and the electronic device 102-2 may each receive information through the electrical connection with the charger 310. For example, the electronic device 102-1 and the electronic device 102-2 may each receive information obtained by the charger 310, in response to the request. For example, the received information may include time data measured by the charger 310.

According to an embodiment, the electronic device 102-1 and the electronic device 102-2 may each be referred to as an earbud or earbuds, a wireless earphone, a wireless headphone, a wearable device, and so on.

The charger 310 may provide power to one or more of the electronic device 102-1 and the electronic device 102-2. The charger 310 may provide power through the electrical connection between one or more of the electronic device 102-1 and the electronic device 102-2 and the charger 310. In an embodiment, the charger 310 may provide power to one or more of the electronic device 102-1 or the electronic device 102-2, using the rechargeable battery of the charger 310. The charger 310 may provide power received externally by wire or wirelessly, to one or more of the electronic device 102-1 or the electronic device 102-2, without the battery.

The charger 310 may receive a signal, data, or information from one or more of the electronic device 102-1 or the electronic device 102-2. In an embodiment, the charger 310 may receive a signal for requesting one or more of the electronic device 102-1 or the electronic device 102-2 to provide the time information obtained by the charger 310, from one or more of the electronic device 102-1 or the electronic device 102-2.

The charger 310 may transmit a signal, data, or information to one or more of the electronic device 102-1 or the electronic device 102-2. In an embodiment, the charger 310 may transmit its obtained time information to one or more of the electronic device 102-1 or the electronic device 102-2, as a response signal to the request signal.

According to an embodiment, the charger 310 may be referred to as a cradle, a dock, and so on.

Figure 4:
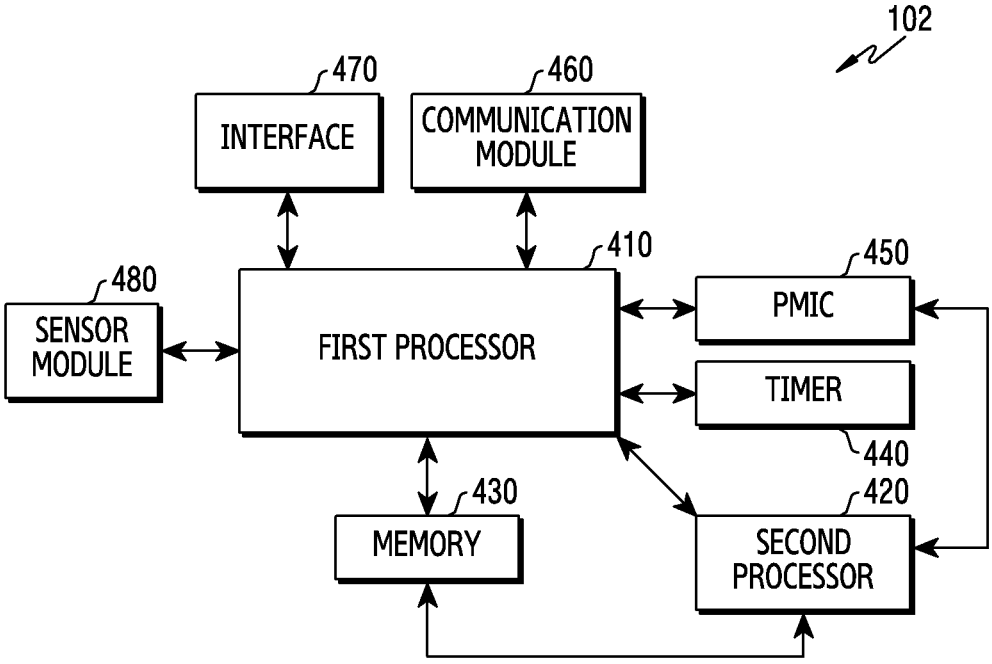
FIG. 4 is a block diagram of an electronic device according to an embodiment.

FIG. 4 is a block diagram of an electronic device according to an embodiment. At least part of the block diagram of FIG. 4 may be included in at least one of the electronic device 102 of FIG. 1, the electronic device 102-1 of FIG. 3, or the electronic device 102-2 of FIG. 3.

Referring to FIG. 4, the electronic device 102 may include a first processor 410, a second processor 420, a memory 430, a timer 440, a PMIC 450, a communication module 460, an interface 470, and a sensor module 480.

The first processor 410 may control operations of the electronic device 102. To control the operations of the electronic device 102, the first processor 410 may be operably coupled to another component of the electronic device 102, such as the second processor 420, the memory 430, the timer 440, the PMIC 450, the communication module 460, the interface 470, and the sensor module 480.

In an embodiment, the first processor 410 may include a single processor core or multiple processor cores. For example, the first processor 410 may include a multi-core such as a dual-core, a quad-core, or a hexa-core. The first processor 410 may further include a cache memory disposed inside or outside the first processor 410.

The first processor 410 may receive commands of the other components of the electronic device 102, interpret a received command, and process a calculation or data according to the interpreted command.

The first processor 410 may process data or a signal occurring in the electronic device 102. For example, the first processor 410 may request a command, data, or a signal from the memory 430. To control the electronic device 102 or to control another component of the electronic device 102, the first processor 410 may record (or store) or refine a command, data, or a signal in the memory 430.

The first processor 410 may analyze and process a message, data, a command, or a signal received from the second processor 420, the timer 440, the PMIC 450, the communication module 460, the interface 470, or the sensor module 480. The first processor 410 may generate a new message, data, command, or signal based on the received message, data, command, or signal. The first processor 410 may provide the processed or generated message, data, command, or signal to the second processor 420, the memory 430, the timer 440, the PMIC 450, the communication module 460, the interface 470, or the sensor module 480.

The first processor 410 may operate based on steady state power (or a steady state voltage). If receiving power (or a voltage) greater than a reference power (or a reference voltage) from the PMIC 450, the first processor 410 may operate in an active state or in an activate state. The active state may indicate a state for processing an interrupt or a task. The active state may be referred to as a wake-up state (or mode). If the power (or voltage) from the PMIC 450 is restricted, the first processor 410 may operate in an inactive state or in an inactivate state. For example, if receiving power less than the reference power from the PMIC 450, the first processor 410 may operate in an idle state, a sleep state, or a standby state, requiring no booting to switch to the active state. For example, if the power (or voltage) from the PMIC 450 is restricted, the first processor 410 may switch to a turn-off state which requires the booting to switch to the active state.

According to an embodiment, the first processor 410 may be referred to as an AP or a micro controller unit (MCU), which controls a high-layer program such as an application program.

The second processor 420 may operate based on lower power than the reference power (or voltage). If the electronic device 102 operates with low power, the second processor 420 may switch from the inactive state to the active state. If the electronic device 102 may operates with low power or the first processor 410 operates in the inactive state, the second processor 420 may control the operations of the electronic device 102. For example, the second processor 420 may measure an internal temperature of the electronic device 102 in the low power state. For example, the second processor 420 may monitor a connection state of a pin of the interface 470 in the low power state. For example, the second processor 420 may control the sensor module 480 in the low power state. For example, the second processor 420 may monitor whether the electronic device 102 is charged in the low power state. For example, the second processor 420 may obtain time information in the low power state.

To control the electronic device 102 of the low power state, the second processor 420 may be electrically or operably coupled or connected to another component (e.g., the memory 430, the PMIC 450, or the sensor module 480) of the electronic device 102.

The memory 430 may store a command for controlling the electronic device 102, control command code, control data, or user data. For example, the memory 430 may include an application, an OS, a middleware, and a device driver.

The memory 430 may include one or more of a volatile memory or a non-volatile memory. The volatile memory may include a dynamic random access memory (DRAM), a static RAM (SRAM), a synchronous DRAM (SDRAM), a phase-change RAM (PRAM), a magnetic RAM (MRAM), a resistive RAM (RRAM), and a ferroelectric RAM (FeRAM). The non-volatile memory may include a read only memory (ROM), a programmable ROM (PROM), an electrically PROM (EPROM), an electrically erasable PROM (EEPROM), or a flash memory.

The memory 430 may include a non-volatile medium such as a hard disk drive (HDD), a solid state disk (SSD), an embedded multimedia card (eMMC), and a universal flash storage (UFS).

The timer 440 may measure the time. The timer 440 may measure the time based on a clock frequency provided from the first processor 410. The timer 440 may measure the time based on the power provided from the PMIC 450. If receiving the power from the PMIC 450, the timer 440 may measure the time independently from (regardless of) the processing of the first processor 410. For example, the timer 440 may measure time elapsed since the time (e.g., local time) information is received from an external electronic device (e.g., the electronic device 101). The timer 440 may provide information associated with the measured time (e.g., measured time information) to the first processor 410.

The timer 440 may operate based on the steady state power (or the steady state voltage). If receiving the power (or voltage) over the reference power (or the reference voltage) from the PMIC 450, the timer 440 may operate in the active state. The active state may indicate a state for enabling the time measurement. The active state may be referred to as the wake-up state (or mode). If the power (or voltage) from the PMIC 450 is restricted, the timer 440 may operate in the inactive state. For example, if receiving lower power than the reference power from the PMIC 450, the timer 440 may operate in the idle state, the sleep state, or the standby state, requiring no booting to switch to the active state. For example, if the power (or voltage) from the PMIC 450 is restricted, the timer 440 may operate in the turn-off state requiring the booting to switch to the active state.

The PMIC 450 may be configured to supply the power or apply the voltage to other component of the electronic device 102. The PMIC 450 may be configured to restrict the power (or voltage) provided to another component of the electronic device 102. For example, the PMIC 450 may cut the power provided to another component of the electronic device 102 or may provide adjusted (or reduced) power to another component of the electronic device 102. The PMIC 450 may be connected with the rechargeable battery.

The communication module 460 may be used to generate the communication path between another electronic device and the electronic device (e.g., the communication path between the electronic device 101 and the electronic device 102, the communication path between the electronic device 102-1 and the electronic device 102-2, etc.). The communication module 460 may be a module for at least one of the Bluetooth® communication scheme, the BLE communication scheme, the Wi-Fi communication scheme, the cellular or mobile communication scheme, or the wired communication scheme. The communication module 460 may provide a signal, information, or data received from another electronic device in the communication path, to the first processor 410. The communication module 460 may transmit information or data provided from the first processor 410, to the other electronic device in the communication path.

The interface 470 may be used to generate the electrical connection with an external electronic device (e.g., the charger of FIG. 3). In an embodiment, the interface 470 may be configured with one or more of at least one charging pin or at least one detecting pin. A shape of the at least one charging pin may correspond to a shape of the charging pad of the external electronic device, and a shape of the at least one detecting pin may correspond to a shape of at least one detecting pad of the external electronic device. At least a part of the interface 470 may be exposed through a part of a housing of the electronic device 102, for physical connection with the external electronic device.

The interface 470 may receive power from the external electronic device through the electrical connection. The interface 470 may provide the supplied power to the battery through the PMIC 450.

The interface 470 may transmit a signal to the external electronic device through the electrical connection. The signal may request time information. The signal may be received at the interface 470 from one or more of the first processor 410 or the second processor 420. The signal may be provided to the external electronic device through the electrical connection.

The interface 470 may receive a signal from the external electronic device through the electrical connection. The signal may be a response signal to the time information request. The interface 470 may provide the signal received from the external electronic device through the electrical connection, to the first processor 410 or the second processor 420.

The interface 470 may support a designated protocol which may connect the external electronic device (e.g., the charger of FIG. 3) by wire or wirelessly.

The sensor module 480 may measure a physical quantity or detect an operational state of the electronic device 102, and convert the measured or detected information into an electrical signal. The sensor module 480 may include, for example, one or more of a gesture sensor, a gyro sensor, an atmospheric pressure sensor, a magnetic sensor, an acceleration sensor, a grip sensor, a proximity sensor, a color sensor, a biometric sensor, a temperature/humidity sensor, an illuminance sensor, or an ultra violet (UV) light sensor. Additionally or alternatively, the sensor module 480 may include, for example, an e-nose sensor, an electromyography (EMG) sensor, an electroencephalogram (EEG) sensor, an electrocardiogram (ECG) sensor, a near-infrared (NIR) sensor, an infrared (IR) sensor, an iris scan sensor, and/or a fingerprint scan sensor. The sensor module 480 may include at least one sensor and thus obtain a user's biometric information (e.g., step information, calorie consumption information, heart rate information, stress level information, or oxygen saturation information) of the electronic device 102.

In an embodiment, the first processor 410 may identify a battery state of the electronic device 102. Based on information indicating the battery state received from the PMIC 450, the first processor 410 may identify remaining capacity (or voltage) of the battery. If the remaining capacity (or voltage) of the battery falls within a first range (or a first voltage range), the first processor 410 may refine a reference time of the first processor 410 using the time information obtained from the external electronic device such as the electronic device 102. The first range may be configured to identify whether the electronic device 102 may operate in the steady power state (or the steady voltage state) (or whether the steady power or (the steady state voltage) may be supplied to the first processor 410). Upon identifying that the remaining capacity of the battery falls within the first range, the first processor 410 may identify that the electronic device 102 operates in the steady power state. The reference time of the first processor 410 may indicate a current time of a place where the electronic device 102 is located, which is determined by the first processor 410 based on the obtained time information. If the remaining capacity of the battery falls within the first range, the first processor 410 may refine its reference time, based on the time information measured by the timer 440 and received from the timer and the time information obtained from the external electronic device.

If the remaining capacity of the battery falls within a second range, the first processor 410 may control the second processor 420 to activate the second processor 420 of the inactivate state. The second range may be configured to identify whether the electronic device 102 is required to operate in the low power state (or whether power less than the reference power is supplied to the first processor 410). Upon identifying that the remaining capacity of the battery falls within the second range, the first processor 410 may identify that the electronic device 102 operates in the low power state (switches to the low power state). For example, the first processor 410 may transmit a control signal to the PMIC 450 to supply the power to the second processor 420. For example, the first processor 410 may transmit to the second processor 420 a control signal requesting (or commanding) to switch the state of the second processor 420 to the active state. Based on the control signal, the second processor 420 may switch from the inactive state to the active state.

The second processor 420 of the active state may refine its reference time using the time information obtained from the external electronic device such as the electronic device 102. The reference time of the second processor 420 may indicate the current time of the place where the electronic device 102 is located, which is determined by the second processor 420 based on the time information obtained from the external electronic device. The second processor 420 may determine its reference time based on its clock frequency and the time information.

If the second processor 420 is activated, the first processor 410 may switch to the inactive state. For example, based on identifying the active state of the second processor 420, the first processor 410 may transmit a control signal to the PMIC 450. The PMIC 450 receiving the control signal may restrict the power supplied to the first processor 410 and the timer 440. Based on the restriction, the first processor 410 may switch to the inactive state.

The first processor 410 according to an embodiment may receive time information from the electronic device 101. The time may correspond to local time of the place where the electronic device is located. The first processor 410 may monitor the remaining capacity of the rechargeable battery which is connected to the PMIC 450. While the remaining capacity of the battery is greater than or equal to a reference value, the first processor 410 may obtain using the timer 440, first information regarding elapsed time since the time information is received from the electronic device 101. The reference value may be configured to identify whether the power state of the battery may supply the steady state power to the first processor 410 and the timer 440. For example, if the remaining capacity of the battery is greater than or equal to the reference value, the first processor 410 and the timer 440 may receive the steady state power from the battery through the PMIC 450. If the remaining capacity of the battery is greater than or equal to the reference value, the first processor 410 and the timer 440 may operate in the active state. For example, if the remaining capacity of the battery is less than the reference value, the power supplied from the battery to the first processor 410 and the timer 440 through the PMIC 450 may be less than the steady state power, or the power supplied to the first processor 410 and the timer 440 may be cut. If the remaining capacity of the battery is less than the reference value, the first processor 410 and the timer 440 may switch from the active state to the inactive state and the second processor 420 may switch from the inactive state to the active state. If the remaining capacity of the battery is less than the reference value, the first processor 410 and the timer 440 switch to the inactive state and accordingly a user of the electronic device 102 may recognize that the electronic device 102 is discharged. For example, if the remaining capacity of the battery is less than the reference value, the first processor 410 is in the inactive state and the electronic device 102 may not output the audio or may not obtain the biometric information. Namely, if the remaining capacity of the battery is less than the reference value, at least one designated operation (e.g., the operation of the electronic device 102 executed by the second processor 420) of electronic device 102 and operations of the other electronic device 102 may be ceased or terminated.

In an embodiment, the first processor 410 may obtain current time information based on at least the received time information or the first information.

In an embodiment, the first processor 410 may identify that the remaining capacity of the battery is less than the reference value. In response to identifying that the remaining capacity of the battery is less than the reference value, the first processor 410 may switch the state of the second processor 420 from the inactive state to the active state. For example, while the remaining capacity of the battery is greater than or equal to the reference value, the second processor 420 may operate in the idle state, the sleep state, or the standby state, not requiring booting to switch to the active state. In response to identifying that the remaining capacity of the battery is less than the reference value, the first processor 410 may switch the state of the second processor 420 to the active state by transmitting a control signal to the second processor 420. For example, while the remaining capacity of the battery is greater than or equal to the reference value, the second processor 420 may be in the turn-off state requiring booting to switch to the active state. In response to identifying that the remaining capacity of the battery is less than the reference value, the first processor 410 may switch the state of the second processor 420 to the active state by transmitting a control signal to the second processor 420. After the second processor 420 switches to the active state, the first processor 410 may switch to the inactive state. After the second processor 420 switches to the active state, the timer 440 may switch to the inactive state together with the first processor 410.

In an embodiment, in response to switching to the active state, the second processor 420 may obtain second information regarding time elapsed since the second processor 420 switches to the active state. If the remaining capacity of the battery is less than the reference value, the first processor 140 and the timer 440 are switched to the inactive state and thus the first processor 410 may not obtain the elapsed time information using the timer 440. To obtain the elapsed time information while the first processor 140 and the timer 440 are in the inactive state, the electronic device 102 may obtain the second information regarding the time elapsed since the second processor 420 switches to the active state, using the second processor 420 which may operate based on the low power. Even if the first processor 410 is switched to the inactive state because of the low remaining capacity of the battery after receiving the time information from the electronic device 101, the electronic device 102 may prevent the time measurement from ceasing by measuring the elapsed time using the second processor 420. In other words, even if the first processor 410 is switched to the inactive state because of the low remaining capacity of the battery after receiving the time information from the electronic device 101, the electronic device 102 may measure the elapsed time using the second processor 420 and thus continuously measure the elapsed time regardless of the battery state.

In an embodiment, the second processor 420, in the active state, may identify whether the electronic device 102 is connected with the charger 310. In response to detecting that the electronic device 102 is connected to the charger 310, the second processor 420 may transmit the second information to the first processor 410. In response to detecting that the electronic device 102 is connected to the charger 310, the first processor 410 and the timer 440 may switch from the inactive state to the active state. In response to detecting that the electronic device 102 is connected to the charger 310, the second processor 420 may transmit the second information to the first processor 410 which is switched from the inactive state to the active state. After transmitting the second information, the second processor 420 may switch to the inactive state.

In an embodiment, the first processor 410 may receive the second information. The first processor 410 may obtain current time information, based at least on the time information obtained from the electronic device 101, the first information, and the second information.

In an embodiment, in response to receiving the second information, the first processor 410 may control the timer 440. Using the timer 440, the first processor 410 may obtain third information regarding time elapsed since the first processor 410 switches from the inactive state to the active state. The first processor 410 may obtain the current time information, based at least on the time information obtained from the electronic device 101, the first information, the second information, and the third information.

In an embodiment, in response to detecting that the electronic device 102 is connected to the charger 310, the first processor 410 may identify or monitor whether the battery is fully charged. In response to identifying that the battery is fully charged, the first processor 410 may switch the state of the second processor 420 from the inactive state to the active state. After identifying that the battery is fully charged, the first processor 410 and the timer 440 may switch from the active state to the inactive state. The first processor 410 and the timer 440 may switch to the inactive state, to maintain the state of the fully charged battery.

According to an embodiment, switching the first processor 410 and the timer 440 to the inactive state may be omitted or bypassed. The first processor 410 and the timer 440 may continuously operate in the active state after the battery is fully charged. In this case, the first processor 410 may continuously obtain the third information from the timer 440. For example, if the charger 310 may receive the power from an external, the first processor 410 may continuously obtain the third information through the timer 440, regardless of whether the battery is fully charged.

In an embodiment, in response to switching to the active state, the second processor 420 may obtain fourth information regarding the time elapsed since the switch to the active state. Even if the first processor 410 and the timer 440 is switched to the inactive state for maintaining the fully charged state of the battery after receiving the time information from the electronic device 101, the electronic device 102 may measure the elapsed time using the second processor 420 by the obtaining of the second information and thus prevent the time measurement from ceasing. Namely, by obtaining the fourth information, the electronic device 102 may continuously measure the elapsed time regardless of the battery state.

In an embodiment, in response to switching to the active state, the second processor 420 may request the charger 310 connected to the electronic device 102 to transmit the time information obtained by a timer of the charger 310 to the second processor 420. In response to switching to the active state, the second processor 420 may request to reset or initiate the timer of the charger 310. For example, if the timer of the charger 310 records the time measured in a previous operation, it may be required to reset or initiate the timer of the charger 310 for the sake of accurate time measurement. The second processor 420 may obtain accurate time information by requesting the charger 310 to reset or initiate the timer of the charger 310 in response to switching to the active state.

In an embodiment, in response to the request of the second processor 420, the charger 310 may transmit to the second processor 420, fifth information regarding time elapsed since the request of the second processor 420. The second processor 420 may receive the fifth information.

In an embodiment, the second processor 420 may refine the fourth information based at least on the fifth information. The second processor 420 may perform a different operation from obtaining the fourth information. For example, while obtaining the fourth information, the second processor 420 may receive an interrupt from other component of the electronic device 102. For example, an interrupt different from or distinct from obtaining the fourth information may be occurred in the second processor 420. If the interrupt has a higher priority than obtaining the fourth information, the second processor 420 may cease obtaining the fourth information to process the interrupt, and process the interrupt. In response to finishing the interrupt processing, the second processor 420 may restore obtaining the fourth information. To compensate for error or distortion caused by ceasing to obtain the fourth information, the second processor 420 may refine the fourth information based at least on the fifth information.

In an embodiment, while the second processor 420 operates in the active state, the second processor 420 may monitor or identify whether the connection between the electronic device 102 and the charger 310 is released. If the connection between the electronic device 102 and the charger 310 is maintained, the second processor 420 may continuously obtain the fourth information and refine the fourth information. In contrast, if the electronic device 102 and the charger 310 are disconnected, the second processor 420 may transmit the obtained fourth information or the refined fourth information to the first processor 410. In response to the disconnection of the electronic device 102 and the charger 310, the second processor 420 may transmit the obtained fourth information or the refined fourth information to the first processor 410 which is switched to the active state. The first processor 410 may receive the obtained fourth information or the refined fourth information.

In an embodiment, the first processor 410 may obtain current time information based on at least the time information obtained from the electronic device 101, the first information, the second information, the third information, and the fourth information. By obtaining the current time information based at least on the time information obtained from the electronic device 101, the first information, the second information, the third information, and the fourth information, the first processor 410 may provide a service associated with the current time even if the electronic device 102 operates in a standalone state without associating with the electronic device 101. The first processor 410 may associate the current time information with other information. The first processor 410 may process the other information associated with the current time information. For example, the first processor 410 may output biometric information associated with the current time information, as an audio signal, or transmit the biometric information associated with the current time information to other electronic device such as the electronic device 101. For example, the first processor 410 may process alarm information based on the current time information. The first processor 410 may output the alarm based on the current time information. For example, based on the current time information, the first processor 410 may determine the latest audio (e.g., playlist or music) outputted from the electronic device 102. For example, if the electronic device 102 is configured as two devices (e.g., the electronic device 102-1 and the electronic device 102-2 of FIG. 3) and the two devices each operate independently, first audio which is outputted most recently from the first electronic device 102-1 may be different from second audio most recently outputted from the second electronic device 102-2. Based on the current time information, the electronic device 102 may determine the latest audio among the first audio and the second audio. In response to receiving a user's input for playing the audio, the electronic device 102 may output the determined audio.

As such, the electronic device 102 according to an embodiment may measure the time independently from the battery state of the electronic device 102, through the time measurement of the second processor 420 which operates with the low power. The electronic device 102 may measure the time independently from the battery state of the electronic device 102, using the second processor 420 and the timer of the charger 310. The electronic device 102 may provide various services associated with the current time, by obtaining the current time information based on the measured time.

Figure 5:
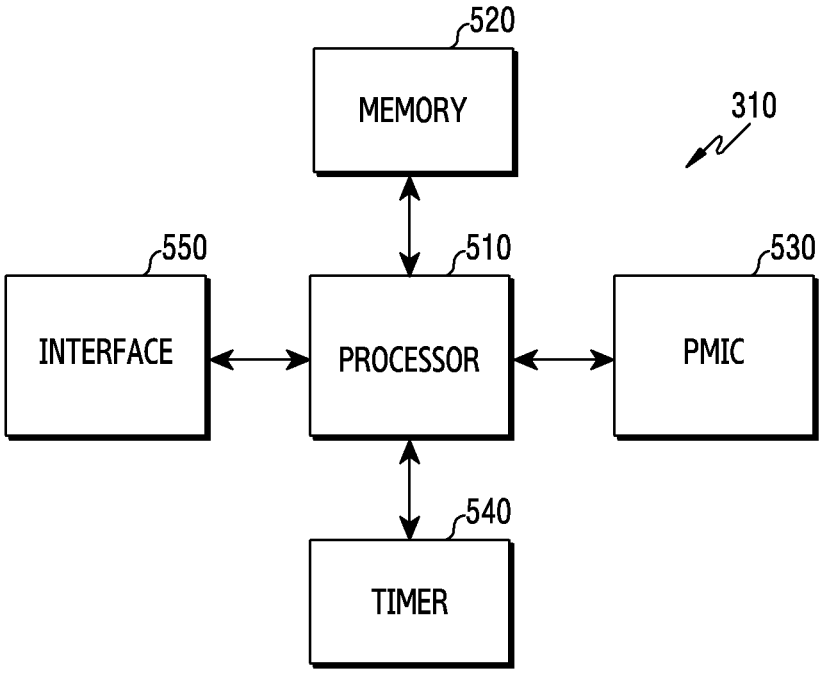
FIG. 5 is a block diagram of a charger according to an embodiment.

FIG. 5 is a block diagram of a charger according to an embodiment. Such a functional configuration may be included in the charger 310 of FIG. 3.

Referring to FIG. 5, the charger 310 may include a processor 510, a memory 520, a PMIC 530, a timer 540, and an interface 550.

The processor 510 may control operations of the charger 310. To control the operations of the charger 310, the processor 510 may be operably coupled to another component of the charger 310, such as the memory 520, the PMIC 530, the timer 540, and the interface 550.

In an embodiment, the processor 510 may include a single processor core or multiple processor cores. For example, the processor 510 may include a multi-core such as a dual-core, a quad-core, or a hexa-core. The processor 510 may further include a cache memory disposed inside or outside the processor 510.

The processor 510 may receive commands of the other components of the charger 310, interpret the received commands, and process a calculation or data according to the interpreted commands.

The processor 510 may process data or a signal occurring in the charger 310. For example, the processor 510 may request a command, data, or a signal from the memory 520. To control the charger 310 or another component of the charger 310, the processor 510 may record (or store) or refine a command, data, or a signal in the memory 520.

The processor 510 may analyze and process a message, data, a command, or a signal received from the memory 520, the PMIC 530, the timer 540, or the interface 550. The processor 510 may generate a new message, data, command, or signal based on the received message, data, command, or signal. The processor 510 may provide the processed or generated message, data, command, or signal to the memory 520, the PMIC 530, the timer 540, or the interface 550.

According to an embodiment, the processor 510 may be referred to as an AP or a MCU, which controls a high-layer program such as an application program.

The memory 520 may store a command for controlling the charger 310, control command code, control data, or user data. For example, the memory 520 may include one or more of an application, an OS, a middleware, or a device driver.

The memory 520 may include one or more of a volatile memory or a non-volatile memory. The volatile memory may include a DRAM, an SRAM, an SDRAM, a PRAM, an MRAM, an RRAM, and a FeRAM. The non-volatile memory may include a ROM, a PROM, an EPROM, an EEPROM, or a flash memory.

The memory 520 may include a non-volatile medium such as an HDD, an SSD, an eMMC, or a UFS.

The PMIC 530 may be configured to supply power or to apply a voltage to another component of the charger 310.

The timer 540 may measure the time. The timer 540 may measure the time based on a clock frequency provided from the processor 510. The timer 540 may measure the time based on the power provided from the PMIC 530. If receiving power from the PMIC 530, the timer 540 may measure the time independently from the processing of the processor 510.

The interface 550 may be used to generate the electrical connection with an external electronic device (e.g., the electronic device 102 of FIG. 3 and FIG. 4). In an embodiment, the interface 550 may be configured with one or more of at least one charging pad or at least one detecting pad. A shape of the at least one charging pad may correspond to a shape of at least one charging pin of the external electronic device, and a shape of the at least one detecting pad may correspond to a shape of at least one detecting pin of the external electronic device. At least a part of the interface 550 may be exposed through a part of a housing of the charger 310, for physical or electrical connection with the external electronic device, according to the state (e.g., the charger 310 is opened) of the charger 310.

The interface 550 may supply power from the external electronic device through the electrical connection. The interface 550 may provide the power supplied from the PMIC 530 to the external electronic device.

The interface 550 may receive a signal from the external electronic device through the electrical connection. The signal may request to measure the time using the timer 540. The signal may be provided to the processor 510 through the interface 550.

The interface 470 may transmit a signal to the external electronic device through the electrical connection. The signal, in response to the request, may include time information measured by the timer 540. The interface 550 may provide the signal received from the processor 510, to the external electronic device.

The interface 550 may support a designated protocol which may connect the external electronic device by wire or wirelessly.

In an embodiment, the processor 510 may receive a request signal from the electronic device 102 through the interface 550. The request signal may be received at the processor 510 from the second processor 420 through the interface 550. The request signal may request to measure the time using the timer 540. The request signal may request to reset or initiate the timer 540. The request signal may be transmitted from the electronic device 102 after the battery of the electronic device 102 is fully charged and the second processor 420 is activated.

In an embodiment, in response to the request, the processor 510 may transmit a signal including the time information obtained by the timer 540. The processor 510 may receive the time information measured by the timer 540, from the timer 540. The processor 510 may transmit the time information to the electronic device 102 through the interface 550. The time information may be transmitted to the electronic device 102 based on a designated period. The time information may be transmitted to the electronic device 102, in response to detecting, at the charger 310, that a cover of the charger 310 connected to the electronic device 102 is opened. After transmitting the time information, the time information may be initiated or reset. The time information may be used to refine the time information (e.g., the fourth information) obtained by the second processor 420 after the battery of the electronic device 102 is fully charged.

As such, an electronic device according to an embodiment may include a rechargeable battery, communication circuitry (e.g., the communication module 460 of FIG. 4) configured to communicate with an external electronic device (e.g., the electronic device 101 of FIG. 1 and FIG. 3), a first processor (e.g., the first processor 410 of FIG. 4) configured to, if the voltage of the battery falls within a first voltage range, refine a first reference time using time information obtained from the external electronic device through the communication circuitry, and a second processor (e.g., the second processor 420 of FIG. 4) configured to, if the voltage of the battery falls within a second voltage range, refine a second reference time using the time information obtained from the external electronic device through the communication circuitry.

In an embodiment, one of the first processor and the second processor may be configured to record a user's biometric information associated with the electronic device based on at least the first reference time or the second reference time.

In an embodiment, the electronic device may further include time measurement circuitry (e.g., the timer 440) electrically connected with the first processor. The first processor may be configured to identify whether the voltage of the battery falls within the first voltage range, and, if the voltage of the battery falls within the first voltage range, refine the first reference time based on information received from the time measurement circuitry or the time information.

In an embodiment, the first processor may be configured to identify whether the voltage of the battery falls within the second voltage range, and, if the voltage of the battery falls within the second voltage range, to control a state of the second processor to an active state. In response to switching the state of the second processor to the active state, the second processor may be configured to refine the second reference time using the time information. For example, the second processor may be configured to refine the second reference time using a clock frequency of the second processor and the time information. For example, the electronic device may further include a PMIC 450 connected to the first processor, and the first processor may be configured to, if the voltage of the battery falls within the second voltage range, restrict the voltage provided to the first processor using the PMIC.

In an embodiment, the electronic device may further include an interface 470 configured to be attachable to at least part of another electronic device (e.g., the charger 310 of FIG. 3 and FIG. 5) and to obtain a voltage for recharging the battery. The second processor may be further configured to, while refining the reference time of the second processor, identify whether at least a part of another electronic device is contacted through the interface, transmitting information regarding the refined reference time of the second processor if contacting at least a part of another electronic device, and switching to an inactive state after the transmission the information. For example, the first processor may be further configured to operate in the inactive state while the second processor refines the second reference time, switch from the inactive state to the active state in response to receiving from the second processor information regarding the refined second reference time of the second processor, and refine the first reference time based on the refined second reference time information and the time information. For example, the first processor which operates in the active state may be further configured to identify whether a state of the battery is in a voltage range associated with a full charge state while obtaining the voltage from another electronic device, if the state of the battery is in the voltage range associated with the full charge state, transmit a signal for switching the state of the second processor to the active state to the second processor, and switch to the inactive state. For example, the second processor may be further configured to, in response to receiving from the first processor the signal for switching the state of the second processor to the active state, switch the state of the second processor from the inactive state to the active state, and refine the reference time of the second processor based at least on time information from the another electronic device through the interface.

An electronic device according to an embodiment as stated above may include a communication interface (e.g., the communication module 460 of FIG. 4), a battery configured to be rechargeable, a timer 440, a first processor 410 operably coupled to the communication interface, the battery, and the timer, and a second processor 420 operably coupled to the battery, wherein the first processor may be configured to receive, from an external electronic device, information associated with time, while remaining capacity of the battery is greater than or equal to a reference value, obtain, by using the timer, first information associated with time that is elapsed since the information is received, and in response to identifying that the remaining capacity is less than the reference value, switch a state of the second processor to an active state, and wherein the second processor may be configured to obtain second information associated with time that is elapsed since the second processor is switched to the active state, and in response to detecting that the electronic device is connected to another electronic device (e.g., the charger 310) for recharge of the battery, provide the second information to the first processor.

In an embodiment, the electronic device may further include a PMIC 450, wherein the first processor may be further configured to, in response to identifying that the remaining capacity is less than the reference value, control the PMIC to restrict power provided to the first processor and the timer. For example, the first processor or the timer each may be switched to an inactive state based on the restriction of the power.

For example, the first processor and the timer may each be switched from the inactive state to the active state in response to detecting that the electronic device is connected to another electronic device, wherein the first processor may be further configured to obtain the second information from the second processor, and to obtain third information associated with time that is elapsed since the first processor is switched from the inactive state to the active state, and wherein the second processor may be switched to the inactive state based on detecting that the electronic device is connected to another electronic device.

For example, the first processor may be further configured to switch the second processor in the inactive state to the active state in response to identifying that the battery is fully charged, and the second processor may be configured to obtain fourth information associated with time that is elapsed since the second processor is switched to the active state after the battery is fully charged.

For example, the second processor may be configured to, in response to switching the second processor to the active state after the battery is fully charged, request information associated with time to another electronic device, to obtain fifth information associated with time that is elapsed since a signal is received from the other electronic device in response to the request, and refine the fourth information, based on the fifth information.

For example, the second processor may be further configured to, in response to detecting that the connection between the other electronic device and the electronic device is released, provide the refined fourth information to the first processor. The second processor may determine a battery charging level according to the connection release and activate the first processor.

For example, the first processor may be further configured to obtain information associated with current time based on at least one of the first information, the second information, the third information, and the refined fourth information.

In an embodiment, the electronic device may further include at least one sensor, wherein the first processor may be further configured to obtain information regarding the current time based at least on the first information or the second information, associate biometric information obtained via the at least one sensor with the current time, and store the biometric information that is associated with the current time.

In an embodiment, the second processor may be further configured to, if an interrupt having a higher priority than obtaining the second information occurs, cease obtaining the second information to process the interrupt, and restore obtaining the second information in response to completing the interrupt processing.

An electronic device according to an embodiment may include an interface, time measurement circuitry, and a processor operably coupled to the interface and the time measurement circuitry, where the processor is configured to receive, via the interface from an external electronic device connected to the electronic device, a message for indicating that a battery of the external electronic device is fully charged, identify whether the electronic device is obtaining power externally, if the electronic device is obtaining the power, transmit a signal for activating a processor of the external electronic device that is associated with a timer of the external electronic device to the external electronic device, and if the electronic device is not obtaining the power, measure time by using the time measurement circuitry and transmit information regarding the measured time to the external electronic device.

Figure 6:
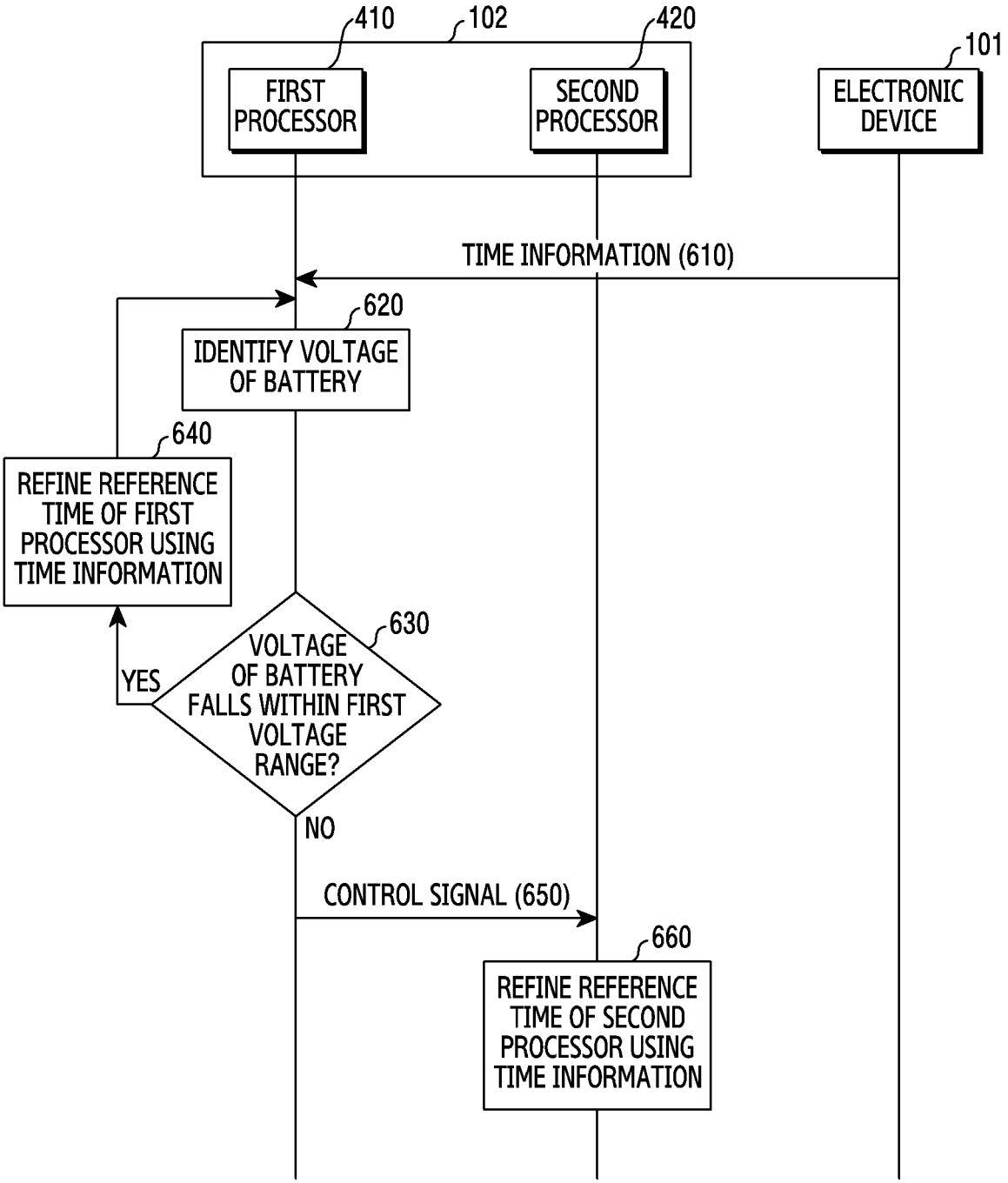
FIG. 6 is a signaling flow diagram of an electronic device according to an embodiment.

FIG. 6 is a signaling flow diagram of an electronic device according to an embodiment. Such signaling may occur in the electronic device 102 of FIG. 1, FIG. 3, or FIG. 4.

Referring to FIG. 6, in step 610, the first processor 410 of the electronic device 102 may receive time information from the electronic device 101. The electronic device 102 may be connected to the electronic device 101. For example, the electronic device 102 may be connected to the electronic device 101, to output audio based on data received from the electronic device 101. For example, the electronic device 102 may receive a playlist or at least one music file from the electronic device 101, to store the playlist or the at least one music file in the electronic device 102. The first processor 410 may receive the time information while the connection between the electronic device 101 and the electronic device 102 is generated. In an embodiment, the time information may be received as a response to a request of the electronic device 102, while the connection is generated. The time information may be received based on a designated protocol associated with the connection without an explicit request of the electronic device 102, while the connection is generated. The first processor 410 may receive the time information after the connection is generated (i.e., after the connection is completed between the electronic device 101 and the electronic device 102). The time information may include local time information of a place where the electronic device 101 is located. The time information may be transmitted based on a first communication scheme. If the electronic device 102 is configured with a plurality of devices (e.g., the electronic device 102-1 and the electronic device 102-2 of FIG. 3), the first communication scheme may be the same as a second communication scheme which is used for communications between the multiple devices. The first communication scheme may be distinguished from the second communication scheme. For example, the first communication scheme may correspond to the Bluetooth® communication scheme, and the second communication scheme may correspond to the BLE communication scheme.

In step 620, the first processor 410 may identify a voltage of the battery of the electronic device 102. To identify whether the electronic device 102 is required to operate with low power, the first processor 410 may identify the voltage of the battery of the electronic device 102.

In step 630, the first processor 410 may determine whether the identified battery voltage falls within a first voltage range. If the identified battery voltage falls within the first voltage range, the electronic device 102 may operate in the steady power state. If the identified battery voltage falls within the first voltage range, the first processor 410 may perform step 640. In contrast, if the identified battery voltage does not fall within the first voltage range or falls within a second voltage range, the electronic device 102 may perform step 650.

In step 640, in response to determining that the identified battery voltage falls within the first voltage range, the first processor 410 may refine the reference time (e.g., the first reference time) of the first processor 410 using the time information. The first processor 410 may refine its reference time, using the timer 440 which is functionally coupled to the first processor 410. The timer 440 may operate independently from the first processor 410. The timer 440 may measure time elapsed since the time information is received, based on steady state voltage supplied from the PMIC 450. The first processor 410 may refine its reference time, based on at least the measured time information received from the timer 440. While the battery voltage falls within the first voltage range, the first processor 410 may repeat step 620, step 630, and step 640.

In step 650, in response to determining that the battery voltage does not fall within the first voltage range or the battery voltage falls within the second voltage range, the first processor 410 may transmit a control signal to the second processor 420. If the battery voltage falls within the second voltage range or does not fall within the first voltage range, the electronic device 102 may operate in the low power state. If the battery voltage falls within the second voltage range or does not fall within the first voltage range, at least some of the components of the electronic device 102 may be deactivated at the same time or in sequence. The control signal may be used to switch the second processor 420 of the inactive state to the active state. The control signal may be a signal for waking up the second processor 420. In an embodiment, the control signal may include the time information received from the electronic device 101. The control signal may be transmitted to the PMIC 450. In this case, the PMIC 450 may provide the power to the second processor 420, based on the control signal received from the first processor 410. Based on the received power, the second processor 420 may switch to the active state.

In step 660, the second processor 420 switching from the inactive state to the active state may refine its reference time (e.g., the second reference time) using the time information. Since the battery voltage falls within the second voltage range or does not fall within the first voltage range, the first processor 410 and the timer 440 may cease their operation. Namely, the first processor 410 may cease to refine its reference time. To make up for or compensate for ceasing the operation of the first processor 410 and the timer 440, the second processor 420 may refine its reference time using the time information.

As such, the electronic device 102 according to an embodiment may prevent the time measurement from ceasing, by measuring the elapsed time while the first processor 410 switches to the inactive state, using the second processor 420 which operates in the low power state.

Figure 7:
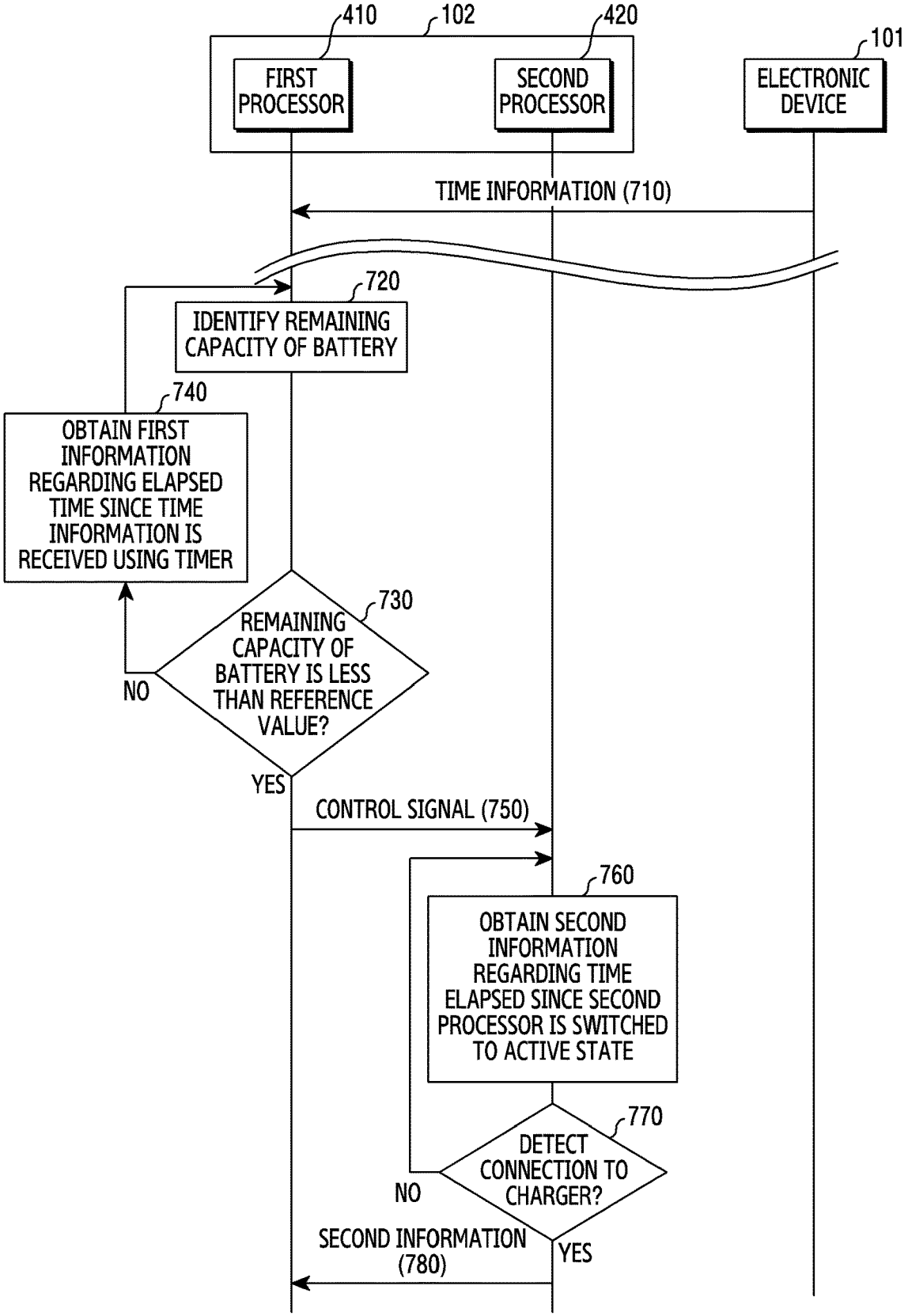
FIG. 7 is a signaling flow diagram of an electronic device according to an embodiment.

FIG. 7 is a signaling flow diagram of an electronic device according to an embodiment.

Referring to FIG. 7, in step 710, the electronic device 101 may transmit time information to the electronic device 102. The time information may include local time information of a place where the electronic device 101 is located. In an embodiment, the electronic device 101 may transmit the time information to the electronic device 102 while a connection between the electronic device 101 and the electronic device 102 is established. The electronic device 101 may transmit the time information after the connection between the electronic device 101 and the electronic device 102 is established. The time information may be transmitted as a response to a request of the electronic device 102, and may be transmitted based on a predetermined protocol without a request of the electronic device 102. The first processor 410 may receive the time information through the communication module 460.

In an embodiment, after the time information is received, the connection between the electronic device 101 and the electronic device 102 may be released. Regardless of the connection release, the electronic device 102 may perform steps 720 through 780 and thus obtain or refine current time (e.g., local time) information of the place where the electronic device 102 is located.

In an embodiment, after the time information is received, the connection between the electronic device 101 and the electronic device 102 may be maintained. The electronic device 102 may obtain or refine the current time (e.g., local time) information of the place where the electronic device 102 is located, by performing step 720 through step 780 even if the local time information of the place where the electronic device 101 is located is not separately received from the electronic device 101 after the time information is received in step 710.

In step 720, the first processor 410 may identify remaining capacity of the battery of the electronic device 102. The first processor 410 may identify the remaining capacity of the battery, to determine whether the state of the electronic device 102 is required to switch to the low power state.

In step 730, the first processor 410 may determine whether the remaining capacity of the battery is less than a reference value. The reference value may be configured to determine whether it is required to switch to the low power state to deactivate at least some of the components of the electronic device 102. In an embodiment, the reference value may be a fixed value. The reference value may be a changeable value. For example, the reference value in the electronic device 102 may adaptively change based on an environment of the electronic device 102 or a load of the electronic device 102. The change may be caused by a user input, and may be caused based on the configuration of the electronic device 102 without a separate input. For example, the reference value may change based on a reduction of the remaining capacity of the battery without a separate user input.

In response to determining or identifying that the remaining capacity of the battery is greater than or equal to the reference value, the first processor 410 may perform step 740. In contrast, in response to determining or identifying that the remaining capacity of the battery is less than the reference value, the first processor 410 may perform step 750.

In step 740, if the remaining capacity of the battery is greater than or equal to the reference value, the first processor 410 may obtain the first information regarding the elapsed time since the time information is received, using the timer 440 connected to the first processor 410. The first processor 410 may obtain information regarding time (e.g., local time of the place where the electronic device 102 is placed when step 740 is performed) when step 740 is performed based at least on the first information.

While the remaining capacity of the battery is greater than or equal to the reference value, the first processor 410 may repeat step 720, step 730, and step 740.

In response to identifying or determining that the remaining capacity of the battery is less than the reference value, the first processor 410 may transmit a control signal to the second processor 420 in step 750. To switch the second processor 420 of the inactive state to the active state, the first processor 410 may transmit the control signal to the second processor 420. In an embodiment, the first processor 410 may transmit the control signal to the PMIC 450, rather than the second processor 420. In this case, the PMIC 450 may switch the second processor 420 to the active state by providing the power to the second processor 420. In addition, after the second processor 420 is switched to the active state, the first processor 410 may switch to the inactive state. That is, the state of the electronic device 102 may switch from the steady power state to the low power state.

In step 760, the second processor 420 which is switched to the active state may obtain the second information regarding time elapsed since the second processor 420 is switched to the active state. In an embodiment, since the second processor 420 does not measure the time associated with a separate module, such as the timer 440, which drives independently from the second processor 420, the time measurement of the second processor 420 may be delayed. For example, if an interrupt of higher priority than obtaining the second information occurs in the second processor 420, the second processor 420 may cease or temporarily cease obtaining the second information in order to process the interrupt. In response to completing the interrupt processing, the second processor 420 may resume obtaining the second information.

In step 770, the second processor 420 which is switched to the active state may detect whether the electronic device 102 is connected to the charger 310. To identify whether the state of the electronic device 102 may switch to the steady power state (or whether the state of the electronic device 102 may switch to the charge state), the second processor 420 which is switched to the active state may detect whether the electronic device 102 is connected to the charger 310. For example, the second processor 420 may detect whether the electronic device 102 is connected to the charger 310, by monitoring at least one detecting pin of the interface 470. If it is detected that the electronic device 102 is connected to the charger 310, the second processor 420 may perform step 780. In contrast, if it is not detected that the electronic device 102 is connected to the charger 310, the second processor 420 may repeat step 770 and step 770.

If it is detected that the electronic device 102 is connected to the charger 310, the second processor 420 may provide the second information to the first processor 410 in step 780. If the electronic device 102 is connected to the charger 310, the second processor 420 may provide the steady state power to the first processor 410. In response to the steady state power, the first processor 410 may switch from the inactive state to the active state. The first processor 410 switching to the active state may receive the second information.

The first processor 410 may obtain information regarding current time (e.g., local time of a place where the electronic device 120 is located), based at least on the time information, the first information, and the second information. The first processor 410 may process the obtained current time information.

As such, even if the electronic device 102 is switched to the low power state, the electronic device 102 according to an embodiment may maintain (or continue) the time measurement by use of the second processor 420. Thus, the electronic device 102 may obtain the local time information of the place where the electronic device 102 is located, without associating with the external electronic device, such as the electronic device 101, which provides the time information. In addition, the electronic device 102 may obtain the local time information of the place where the electronic device 102 is located, without mounting a device such as a real time clock (RTC) which consumes additional power and occupies a mounting area in the electronic device 102. Hence, the electronic device 102 may provide various services associated with the time.

Figure 8:
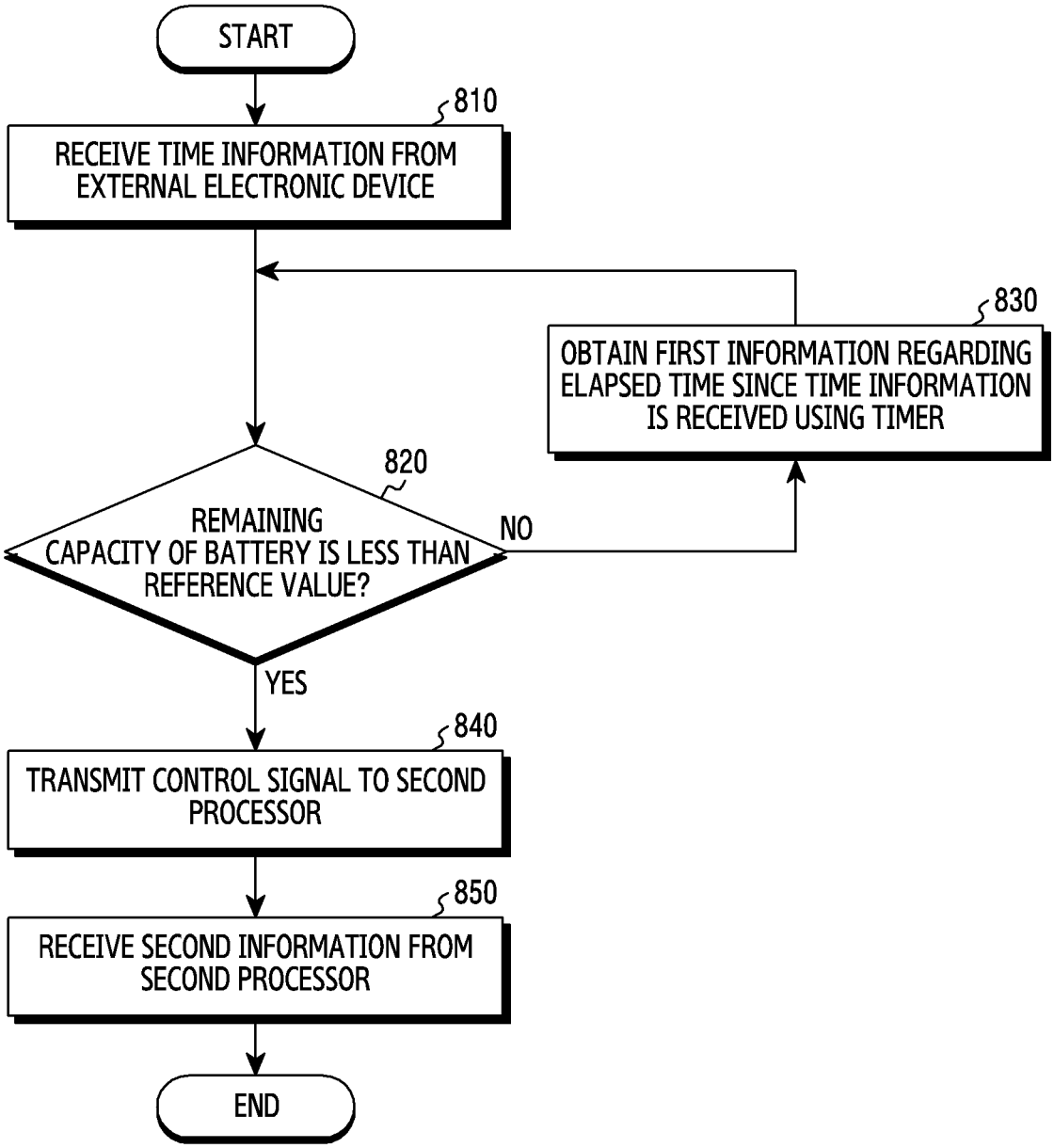
FIG. 8 is a flowchart of a method of a processor in an electronic device according to an embodiment.

FIG. 8 is a flowchart of a method of a processor of an electronic device according to an embodiment.

Referring to FIG. 8, in step 810, the first processor 410 may receive time information from an external electronic device 101. The time information may include local time information of a place where the electronic device 101 is located.

In step 820, the first processor 410 may determine whether a remaining capacity of the battery of the electronic device 102 is less than a reference value. While the remaining capacity of the battery is greater than or equal to the reference value, the first processor 410 may obtain the first information regarding the elapsed time since the time information is received, using the timer 440 connected to the first processor 410 in step 830.

In step 840, in response to identifying that the battery voltage is less than the reference value, the first processor 410 may transmit a control signal to the second processor 420. The control signal may command the second processor 420 to switch to the active state. The second processor 420 may receive the control signal. After transmitting the control signal, the first processor 410 may switch to the inactive state. In response to receiving the control signal, the second processor 420 may switch to the active state. The second processor 420 switching to the active state may obtain the second information regarding the elapsed time since the second processor 420 is switched to the active state, based at least on a clock frequency of the second processor 420. The second processor 420 may obtain the second information until the electronic device 102 is connected to (or attached to) to the charger 310. In response detecting that the electronic device 102 is connected to the charger 310, the second processor 420 may transmit the second information to the first processor 410.

In step 850, the first processor 410 may receive the second information. If the electronic device 102 is connected to the charger 310, the first processor 410 may switch from the inactive state to the active state. The first processor 410 switching to the active state may receive the second information. The first processor 410 may obtain current time information based on the time information, the first information, and the second information.

As such, the electronic device 102 according to an embodiment may obtain the current time information by conducting step 810 through step 850, without associating with other electronic device or mounting an additional device such as RTC. The electronic device 102 may obtain the current time information independently from the battery state of the electronic device 102, in steps 810 through 850.

Figure 9:
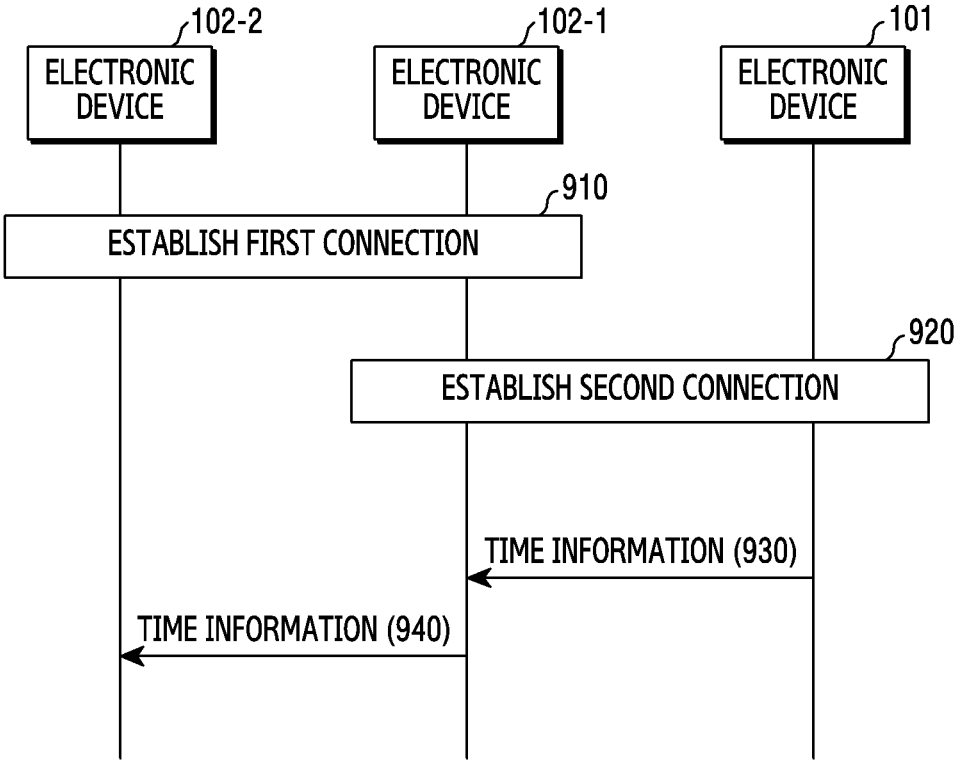
FIG. 9 is a signaling flow diagram between electronic devices and an electronic device according to an embodiment.

FIG. 9 is a signaling flow diagram between electronic devices and an electronic device according to an embodiment.

Referring to FIG. 9, in step 910, the electronic device 102-1 and the electronic device 102-2 may establish a first connection. For example, the electronic device 102-1 may request the first connection from the electronic device 102-2. The electronic device 102-2 may approve the request. Based on the approval, the electronic device 102-1 and the electronic device 102-2 may establish the first connection. The first connection may be established or generated based on the second communication scheme. For example, the second communication scheme may be the BLE communication scheme.

In step 920, the electronic device 102-1 and the electronic device 101 may establish a second connection. For example, the electronic device 101 may request the second connection from the electronic device 102-1. In response to the request, the electronic device 102-1 may provide information for accessing the electronic device 102-1, to the electronic device 101. The electronic device 102-1 may approve the request. Based on the approval or the information for accessing the electronic device 102-1, the electronic device 101 and the electronic device 102-1 may establish the second connection. The second connection may be established or generated based on the first communication scheme. The first communication scheme may be identical with or different from the second communication scheme. If the first communication scheme is different from the second communication scheme, the first communication scheme may be the Wi-Fi direct scheme or the Bluetooth® communication scheme. The electronic device 102-1 connected to the electronic device 101 may be referred to as a master device. The electronic device 102-2 not connected to the electronic device 101 but connected to the electronic device 102-1 may be referred to as a slave device.

In step 930, the electronic device 101 may transmit time information to the electronic device 102-1. The time information may be information measured by the electronic device 101. The time information may be local time information of a place where the electronic device 101 is located. The place information may be acquired through a global positioning system (GPS) module or a communication module of the electronic device 101. The electronic device 102-1 may receive the time information. The electronic device 102-1 may receive the time information through the second connection. After the second connection is established, the electronic device 101 provides the time information in step 930 for the sake of explanations. The electronic device 101 may provide the time information when the second connection is established (e.g., in step 920).

In step 940, the electronic device 102-1 may transmit the time information to the electronic device 102-2. The electronic device 102-1 may transmit the time information to the electronic device 102-2 through the first connection. The electronic device 102-1 which is the master device may provide the time information to the electronic device 102-2 which is the slave device, through the first connection. The electronic device 102-2 may receive the time information through the first connection. That is, the electronic device 102-1 and the electronic device 102-2 may share the time information.

While step 940 of FIG. 9 illustrates an example where the electronic device 102-1 and the electronic device 102-2 share the time information received from the electronic device 101, such an operation may change in various manners. For example, the electronic device 102-1 may transmit not only the time information but also other information (e.g., the first information obtained by the electronic device 102-1, the second information obtained by the electronic device 102-1, the third information obtained by the electronic device 102-1, the fourth information obtained by the electronic device 102-1, or the fifth information obtained by the electronic device 102-1) to the electronic device 102-2.

In addition, while step 940 of FIG. 9 illustrates an example where the electronic device 102-1 which is the master device transmits the time information to the electronic device 102-2 which is the slave device, such an operation may change in various manners. For example, the electronic device 102-2 which is the slave device may transmit not only the time information but also other information (e.g., the first information obtained by the electronic device 102-2, the second information obtained by the electronic device 102-2, the third information obtained by the electronic device 102-2, the fourth information obtained by the electronic device 102-2, or the fifth information obtained by the electronic device 102-2) to the electronic device 102-1 which is the master device.

As such, if including a plurality of devices (e.g., the electronic device 102-1 and the electronic device 102-2), the electronic device 102 according to an embodiment may synchronize the time information of the electronic device 102-1 with the time information of the electronic device 102-2 through signaling between the devices.

Figure 10:
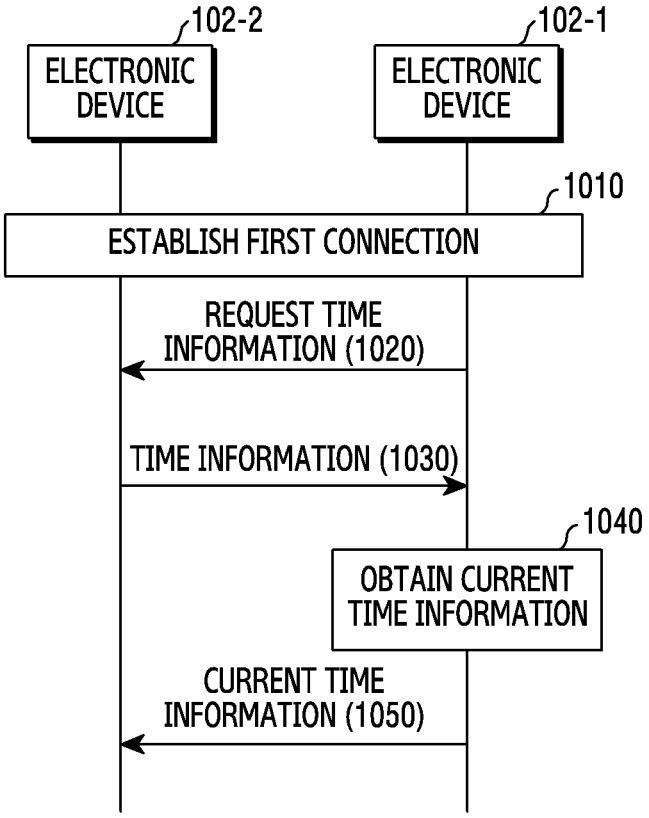
FIG. 10 is a signaling flow diagram between electronic devices according to an embodiment.

FIG. 10 is a signaling flow diagram between electronic devices according to an embodiment. Such signaling may be carried out by the electronic device 102-1 or the electronic device 102-2 of FIG. 3.

Referring to FIG. 10, in step 1010, the electronic device 102-1 and the electronic device 102-2 may establish a first connection. Step 1010 may correspond to step 910 of FIG. 9.

In step 1020, the electronic device 102-1 may request time information from the electronic device 102-2. The electronic device 102-1 requesting the time information may be a device (e.g., a master device) connected to the electronic device 101, or a device not connected to the electronic device 101. Through the first connection, the electronic device 102-1 may request the time information from the electronic device 102-2. The request for the time information may include one or more of a request for the first information obtained by the electronic device 102-2, a request for the second information obtained by the electronic device 102-2, a request for the third information obtained by the electronic device 102-2, a request for the fourth information obtained by the electronic device 102-2, or a request for the fifth information obtained by the electronic device 102-2. The electronic device 102-2 may receive the request through the first connection.

In step 1030, the electronic device 102-2 may transmit the time information to the electronic device 102-1 in response to the request. The electronic device 102-1 may receive the time information.

In step 1040, the electronic device 102-1 may obtain current time information, based at least on the received time information and time information acquired by the electronic device 102-1. For example, the electronic device 102-1 may compare the received time information with the time information acquired by the electronic device 102-1, and thus determine time information adequate for a current state of the electronic device 102-1 among the received time information with the time information acquired by the electronic device 102-1. Based on the determined information, the electronic device may obtain the current time information.

In step 1050, the electronic device 102-1 may transmit the current time information to the electronic device 102-2 through the first connection. The electronic device 102-2 may receive the current time information through the first connection.

As such, the electronic device 102-1 and the electronic device 102-2 may share the current time information through the first connection between the electronic device 102-1 and the electronic device 102-2. By sharing the current time information, the electronic device 102-1 and the electronic device 102-2 may obtain more accurate current time information.

Figure 11:
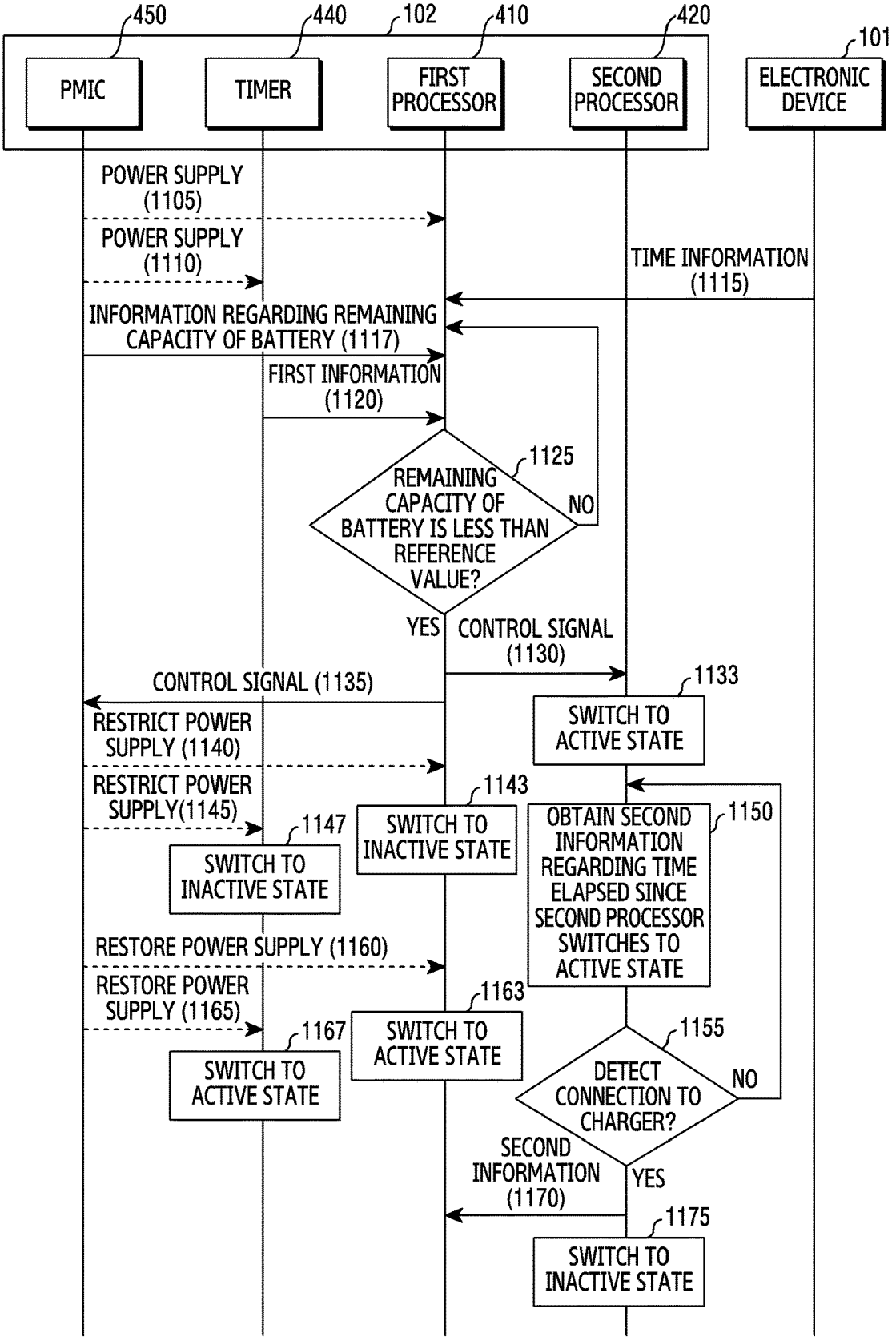
FIG. 11 is a signaling flow diagram of an electronic device according to an embodiment.

FIG. 11 is a signaling flow diagram in an electronic device according to an embodiment.

Referring to FIG. 11, in step 1105, the PMIC 450 may provide power to the first processor 410, based on power of the battery connected to the PMIC 450. The first processor 410 may operate in the active state, based on the provided power.

In step 1110, the PMIC 450 may provide power to the timer 440, based on the power of the battery. Based on the provided power, the timer 440 may operate in the active state.

In FIG. 11, step 1105 precedes step 1110. However, step 1105 and step 1110 may be performed at the same time or in reverse order.

In step 1115, the electronic device 101 may transmit time information to the electronic device 102. The time information may be received at the first processor 410 through the communication module 460. The time information may include local time information of a place where the electronic device 101 is located.

In step 1117, the PMIC 450 may transmit remaining capacity information of the battery to the first processor 410. The remaining capacity information of the battery may be transmitted to the first processor 410 on a periodic basis. The remaining capacity information of the battery may be transmitted from the PMIC 450 based on a request of the first processor 410. The first processor 410 may receive the remaining capacity information of the battery.

In step 1120, the timer 440 may transmit to the first processor 410, the first information regarding time elapsed since the time information is received from the electronic device 101. Since the timer 440 receives the power from the PMIC, the timer 440 may measure the first information. The timer 440 may transmit the measured first information to the first processor 410. The first processor 410 may receive or obtain the first information from the timer 440.

In FIG. 11, step 1117 precedes step 1120. However, step 1117 and step 1120 may be conducted at the same time or in reverse order.

In step 1125, the first processor 410 may determine whether the remaining capacity of the battery is less than the reference value. To determine whether the electronic device 102 is in the low power state, the first processor 410 may identify whether the remaining capacity of the battery is less than the reference value. While the remaining capacity of the battery is greater than or equal to the reference value, the first processor 410 .may repeat step 1117 and step 1120. In contrast, based on identifying that the remaining capacity of the battery is less than the reference value, the first processor 410 may perform step 1130.

In step 1130, the first processor 410 may transmit a control signal to the second processor 410. Based on identifying that the remaining capacity of the battery is less than the reference value, the first processor 410 may determine that the electronic device 102 is in the low power state. To switch the state of the electronic device 102 to the low power state, the first processor 410 may transmit to the second processor 420 the control signal for switching the second processor 420 to the active state. The second processor 420 may receive the control signal.

In step 1133, the second processor 420 may switch to the active state in response to receiving the control signal.

In step 1135, the first processor 410 may transmit a control signal to the PMIC 450. The first processor 410 may transmit the control signal for requesting or commanding the PMIC 450 to restrict the power supplied to the first processor 410 and the timer 440, wherein the electronic device 102 may operate in the low power state. The PMIC 450 may receive the control signal.

According to an embodiment, step 1130 may be omitted or bypassed. If step 1130 is omitted or bypassed, the first processor 410 may transmit a signal for requesting or commanding to supply the power to the second processor 420, to the PMIC 450 in step 1135. The PMIC 450 may provide the power to the second processor 420 based on the control signal. Based on the provided power, the second processor 420 may switch to the active state.

In step 1140, the PMIC 450 may restrict the power supplied to the first processor 410, based on the control signal received in step 1135. In step 1143, the first processor 410 may switch to the inactive state, based on the restricted power provision (or supply).

In step 1145, the PMIC 450 may restrict the power supplied to the timer 440, based on the control signal received in step 1135. In step 1147, the timer 440 may switch to the inactive state, based on the restricted power provision. Based on the power restriction, the timer 440 may cease measuring the first information.

In step 1150, the second processor 420 may obtain the second information regarding time elapsed since the second processor 420 switches to the active state. The second processor 420 may obtain the second information, based at least on a lock frequency associated with the second processor 420.

In step 1155, while obtaining the second information, the second processor 420 may detect whether the electronic device 102 is connected to the charger 310. To identify whether the electronic device 102 may switch to the steady power state, the second processor 420 may identify whether the connection of the electronic device 102 to the charger 310 is detected. For identifying, the second processor 420 may monitor the state of the interface 470.

If the electronic device 102 is connected to the charger 310, the PMIC 450 may restore the power supply to the first processor 410 in step 1160. If the electronic device 102 is connected to the charger 310, the first processor 410 may obtain the power from the PMIC 450. In step 1163, the first processor 410 may switch to the active state, based on the obtained power.

If the electronic device 102 is connected to the charger 310, the PMIC 450 may restore the power supply to the timer 440 in step 1165. If the electronic device 102 is connected to the charger 310, the timer 440 may obtain the power from the PMIC 450. In step 1167, the timer 440 may switch to the active state, based on the obtained power. The timer 440 in the active state may restore the time measurement.

In FIG. 11, step 1160 precedes step 1165. However, step 1160 and step 1165 may be conducted at the same time or in reverse order.

In response to detecting that the electronic device 102 is connected to the charger 310, the second processor 420 may transmit the obtained second information to the first processor 410 in step 1170. In response to detecting that the electronic device 102 is connected to the charger 310, the second processor 420 may transmit the obtained second information to the first processor 410 which switches to the active state, and the second processor switches to the inactive state in step 1175. The first processor 410 may receive the second information.

The first processor 410 may obtain current time information (e.g., local time information of a place where the electronic device 120 is located), based at least on the time information, the first information, the second information, and the time information obtained by the timer 440 after the timer 440 is reactivated.

As such, the electronic device 102 according to an embodiment may supplement the time measurement ceased by deactivating the timer 440 due to the switch to the low power state, with the time measurement of the second processor. Thus, the electronic device 102 according to an embodiment may obtain the current time information and thus provide various services using the current time.

Figure 12:
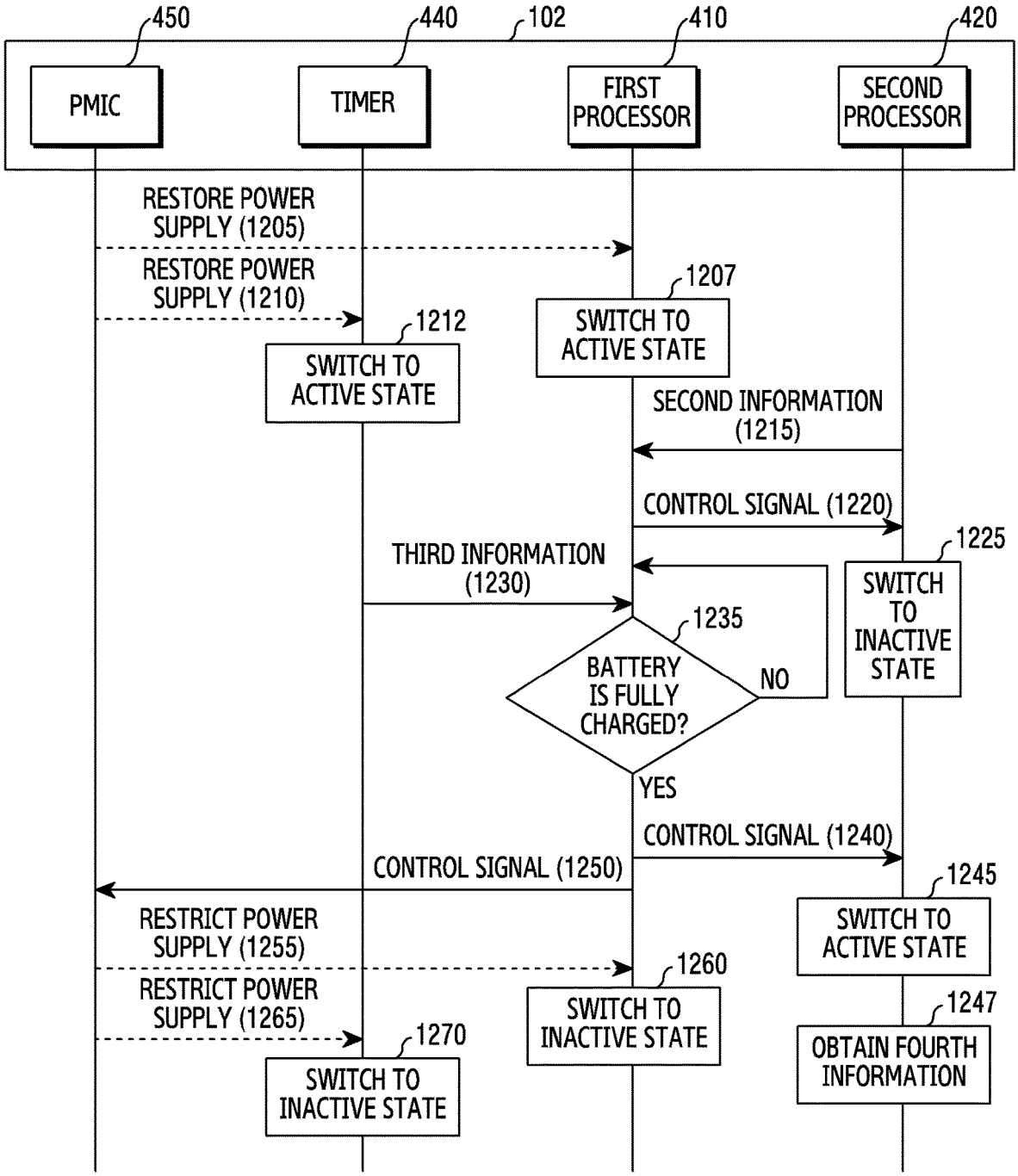
FIG. 12 is a signaling flow diagram of an electronic device according to an embodiment.

FIG. 12 is a signaling flow diagram in an electronic device according to an embodiment.

In FIG. 12, the electronic device 102 may receive power from the charger 310 through electrical connection with the charger 310.

Referring to FIG. 12, in step 1205, the PMIC 450 may restore a power supply to the first processor 410, based on the power from the charger 310. The first processor 410 may switch to the active state in step 1207, based on the restored power supply.

In step 1210, the PMIC 450 may restore the power supply to the timer 440, based on the power from the charger 310. The timer 440 may switch to the active state in step 1212, based on the restored power supply.

In step 1215, the first electronic device 410 may receive the second information from the second processor 420.

Step 1205 through step 1215 may correspond to step 1160 through step 1170 of FIG. 11.

In step 1220, the first processor 410 may transmit a control signal to the second processor 420, based on receiving the second information. The first processor 410 may transmit to the second processor 420, the control signal for switching the state of the second processor 420 to the inactive state. For example, the first processor 410 may transmit to the second processor 420, the control signal for requesting to switch the second processor 420 to the inactive state. The second processor 420 may receive the control signal.

In step 1225, the second processor 420 may switch to the inactive state, based on the control signal. By analyzing the received control signal, the second processor 420 may operate to deactivate the second processor 420. For example, the second processor 420 may transmit to the PMIC 450, a signal for requesting to restrict the power supply to the second processor 420. For example, the second processor 420 may transmit a notification indicating that the second processor 420 switches to the inactive state, to other component of the electronic device 102.

According to an embodiment, the control signal may be transmitted to the PMIC 450. The PMIC 450 may restrict the power supplied to the second processor 420, based on the control signal. Based on the restriction, the second processor 420 may switch to the inactive state.

In step 1230, the timer 440 may transmit to the first processor 410, the third information regarding time elapsed since the timer 440 (or the first processor 410) switches from the inactive state to the active state. The first processor 410 may receive the third information.

Step 1220 and step 1230 may be performed at the same time or regardless of the order according to embodiments.

In step 1235, the first processor 410 may identify whether the battery is fully charged. For example, while obtaining voltage from the charger 310, the first processor 410 may identify whether the battery state is in a voltage range associated with the fully charged state. If the battery is fully charged, the first processor 410 may switch to the inactive state to prevent power consumption by the operation of the first processor 410. To determine a timing for switching to the inactive state, the first processor 410 may identify whether the battery is fully charged. The first processor 410 may conduct step 1230 and step 1235 until the battery is fully charged.

In response to identifying that the battery is fully charged, the first processor 410 may transmit a control signal to the second processor 420 in step 1240. In response to identifying that the battery is fully charged, the first processor 410 may transmit the control signal for activating the second processor 420, to the second processor 420. The second processor 420 may receive the control signal.

In step 1245, the second processor 420 may switch from the inactive state to the active state, based on receiving the control signal.

In step 1247, the second processor 420 may obtain the fourth information regarding time elapsed since the switch to the active state. Namely, the second processor 420 may obtain the fourth information regarding the time from a timing when the battery is fully charged to a timing when the electronic device 102 is removed from the charger 310.

In step 1250, the first processor 410 may transmit a control signal to the PMIC 450. To switch the states of the first processor 410 and the timer 440, the first processor 410 may transmit to the PMIC 450 the control signal for requesting or commanding to restrict the power supplied to the first processor 410 and the timer 440. The PMIC 450 may receive the control signal.

In step 1255, the PMIC 450 may restrict the power supply to the first processor 410 based on the control signal. In step 1260, the first processor 410 may switch to the inactive state according to the restriction.

In step 1265, based on the control signal, the PMIC 450 may restrict the power supply to the timer 440. In step 1270, the timer 440 may switch to the inactive state according to the restriction.

According to an embodiment, step 1240 may be omitted or bypassed. In this case, the first processor 410 may transmit a control signal for requesting or commanding to supply the power to the second processor 420, to the PMIC 450 in step 1250. The PMIC 450 may provide the power to the second processor 420 based on the control signal. Based on the provided power, the second processor 420 may switch to the active state as in step 1245.

As above, if the battery of the electronic device 102 is fully charged, the electronic device 102 according to various embodiments may save the power consumed by the first processor 410 and the timer 440, by switching the states of the first processor 410 and the timer 440. To prevent the time measurement from being ceased by the state change, the electronic device 102 according to various embodiments may activate the second processor 420 and obtain the fourth information using the activated second processor 420.

Figure 13:
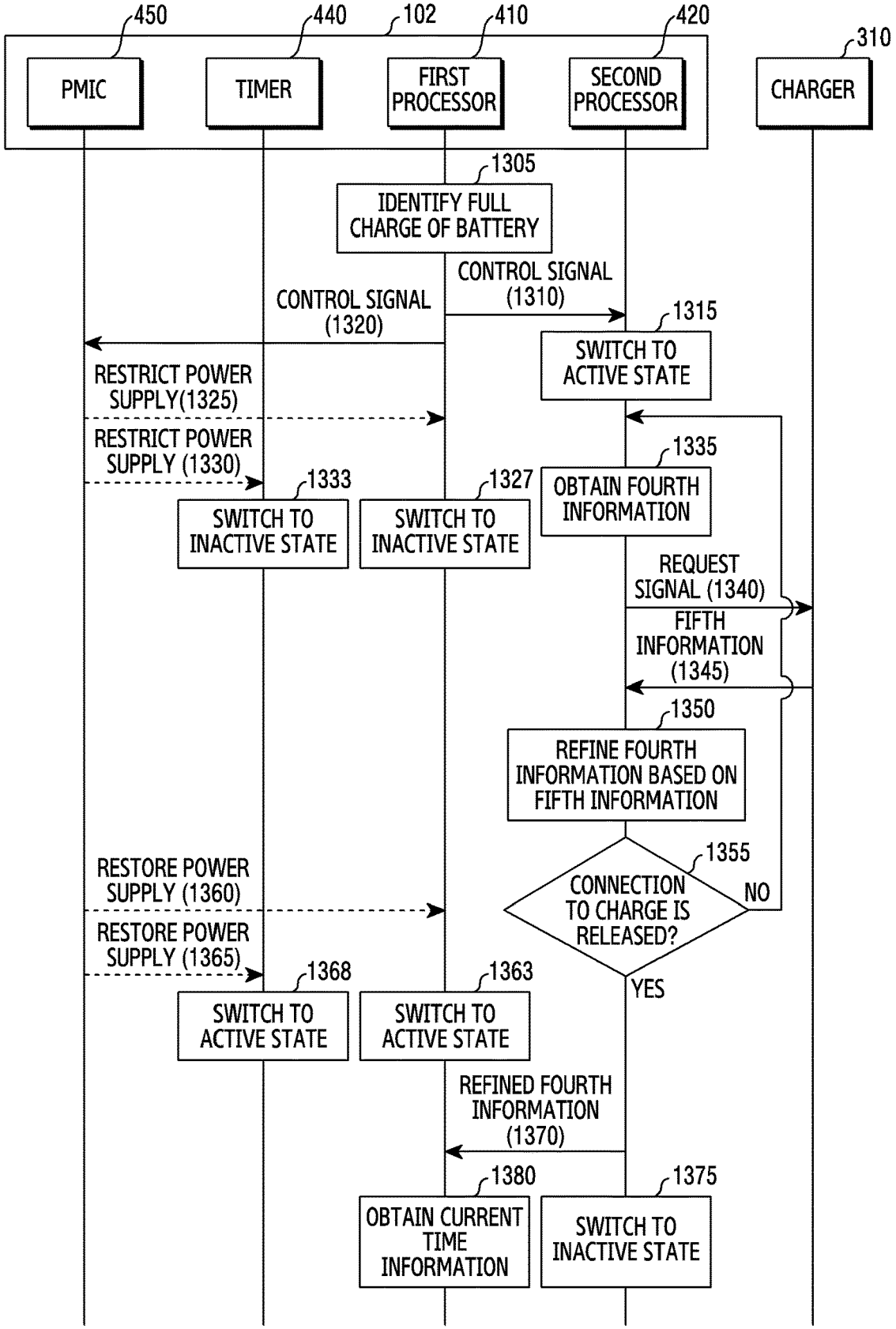
FIG. 13 is a signaling flow diagram of an electronic device according to an embodiment.

FIG. 13 is a signaling flow diagram in an electronic device according to an embodiment.

In FIG. 13, the electronic device 102 may be connected to the charger 310 with its battery fully charged.

Referring to FIG. 13, in step 1305, the first processor 410 may identify that the battery of the electronic device 102 is fully charged. In response to identifying, the first processor 410 may transmit a control signal to the second processor 420 in step 1310.

Based on the control signal, the second processor 420 may switch to the active state in step 1315.

In step 1320, in response to identifying, the first processor 410 may transmit a control signal to the PMIC 450.

In step 1325, the PMIC 450 may restrict power supplied to the first processor 410, based on the control signal. In step 1327, the first processor 410 may switch to the inactive state, based on the power restriction.

In step 1330, the PMIC 450 may restrict the power supplied to the timer 440, based on the control signal. In step 1333, the timer 440 may switch to the inactive state, based on the power restriction. That is, the timer 440 may cease obtaining the third information.

In step 1335, the second processor 420 may obtain the fourth information.

Step 1305 through step 1335 may correspond to step 1240 through step 1247 in FIG. 12, respectively.

In step 1340, the second processor 420 may transmit a request signal to the charger 310 through the interface 470. The request signal may be a signal for requesting to obtain the fifth information regarding time elapsed since the request signal is received at the charger 310, using the timer 540 of the charger 310. The request signal may be a signal for deleting or initiating record or information which has been acquired (or obtained) by the timer 540 of the charger 310. The charger 310 may receive the request signal through the interface 550. The charger 310 (or the processor 510 of the charger 310) may obtain the fifth information regarding the time elapsed since the request signal is received, using the timer 540.

In step 1345, the charger 310 may transmit the obtained fifth information to the second processor 420 through the interface 550. In an embodiment, the fifth information may be periodically received. The transmission period of the fifth information may have a fixed value or a changeable value. For example, the transmission period of the fifth information may adaptively change according to the battery state of the charger 310. The second processor 420 may receive the fifth information through the interface 470. The charger 310 may transmit the fifth information to the second processor 420, in response to detecting that a cover of the charger 310 is opened. The cover opening of the charger 310 may indicate that the connection between the charger 310 and the electronic device 102 is to release. After the transmission, the fifth information may be reset or initiated.

In step 1350, the second processor 420 may refine the fourth information based on the fifth information. An interrupt associated with other operation than obtaining the fourth information may be occurred in the second processor 420. The interrupt may have a higher priority than obtaining the fourth information. In this case, to process the interrupt, the second processor 420 may crease obtaining the fourth information. After processing the interrupt, the second processor 420 may restore obtaining the fourth information. Due to ceasing to obtain the fourth information, the fourth information may include error or distortion. The fifth information, which is obtained by the timer 540 of the charger 310 which is independent from the second processor 420, may not include error or distortion, unlike the fourth information. The second processor 420 may refine the fourth information based on the fifth information, and thus remove or compensate for the error or the distortion in the fourth information.

In step 1355, the second processor 420 may identify whether the connection with the charger 310 is released. While the connection with the charger 310 is maintained, the second processor 420 may repeat step 1335 through step 1350. In contrast, in response to identifying that the connection with the charger 310 is released, the second processor 420 may perform step 1370 (i.e., the second processor transmitting refined information to the first processor 410).

If the connection with the charger 310 is released, the PMIC 450 may restore the power supply to the first processor 410 in step 1360. The connection release may be detected by the PMIC 450 or by the second processor 420. In step 1363, the first processor 410 may switch to the active state based on the restored power supply.

If the connection with the charger 310 is released, the PMIC 450 may restore the power supply to the timer 440 in step 1365. In step 1368, the timer 440 may switch to the active state based on the restored power supply. The timer 440 in the active state may measure time elapsed since the timer 440 switches to the active state, and provide information regarding the measured time to the first processor 410.

The second processor 420 may transmit the refined fourth information to the first processor 410 in step 1370. The first processor 410 may receive the fourth information.

After transmitting the fourth information, the second processor 420 may switch to the inactive state in step 1375. Since the battery is fully charged and remaining capacity of the battery may exceed the reference value, the second processor 420 may switch to the inactive state.

In step 1380, the first processor 410 may obtain current time information, based at least on the refined fourth information. For example, the first processor 410 may obtain the current time information, based on the time information received from the electronic device 101, the first information, the second information, the third information, and the fourth information. The current time may correspond to local time provided from a device which determines the time based on GPS, such as the electronic device 101.

As such, the electronic device 102 according to an embodiment may obtain the current time information, by measuring the time using the second processor 420. The electronic device 102 may supplement the time measurement of the second processor 420, by using the time information measured by the timer 540 of the charger 310 which operates independently from the second processor 420.

Figure 14:
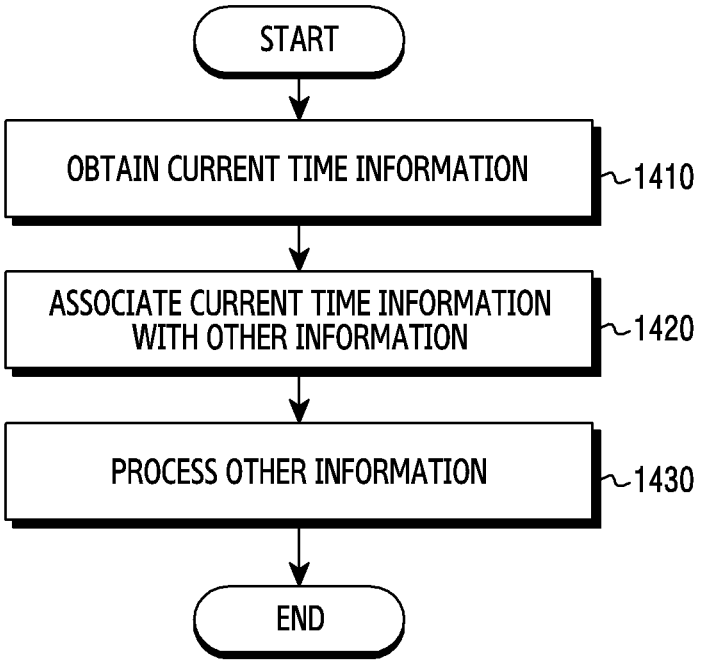
FIG. 14 is a flowchart of a method of an electronic device for processing current time information according to an embodiment.

FIG. 14 is a flowchart of a method of an electronic device for processing current time information according to an embodiment.

Referring to FIG. 14, in step 1410, the first processor 410 may obtain current time information. The current time information may be obtained based on one or more of the time information received from the electronic device 101, the first information, the second information, the third information, or the fourth information.

In step 1420, the first processor 410 may associate the current time information with other information. In an embodiment, the first processor 410 may associate the current time information with biometric information obtained by the sensor module 480. For example, if the user charges the battery of the electronic device 102 and drives the electronic device 102 in the standalone state, the first processor 410 may associate the current time information with a user's biometric information obtained by the driving. The first processor 410 may associate the current time information with music information recently played. For example, the user may play music A stored in the electronic device 102-1 until a timing A using only the electronic device 102-1, and play music B stored in the electronic device 102-2 until a timing B using only the electronic device 102-2. The first processor 410 may compare a time interval between the current time and the timing A with a time interval between the current time and the timing B. According to the comparison, the first processor 410 may determine the music B played at the timing B, as the recently played music. The first processor 410 may play the music B, in response to a user input for the music play.

In step 1430, the first processor 410 may process the other information. For example, the first processor 410 may transmit the biometric information to the electronic device 101, to provide the biometric information through a display. For example, the first processor 410 may output an alarm based on the current time. For example, the first processor 410 may store the other information associated with the current time information.

Figure 15:
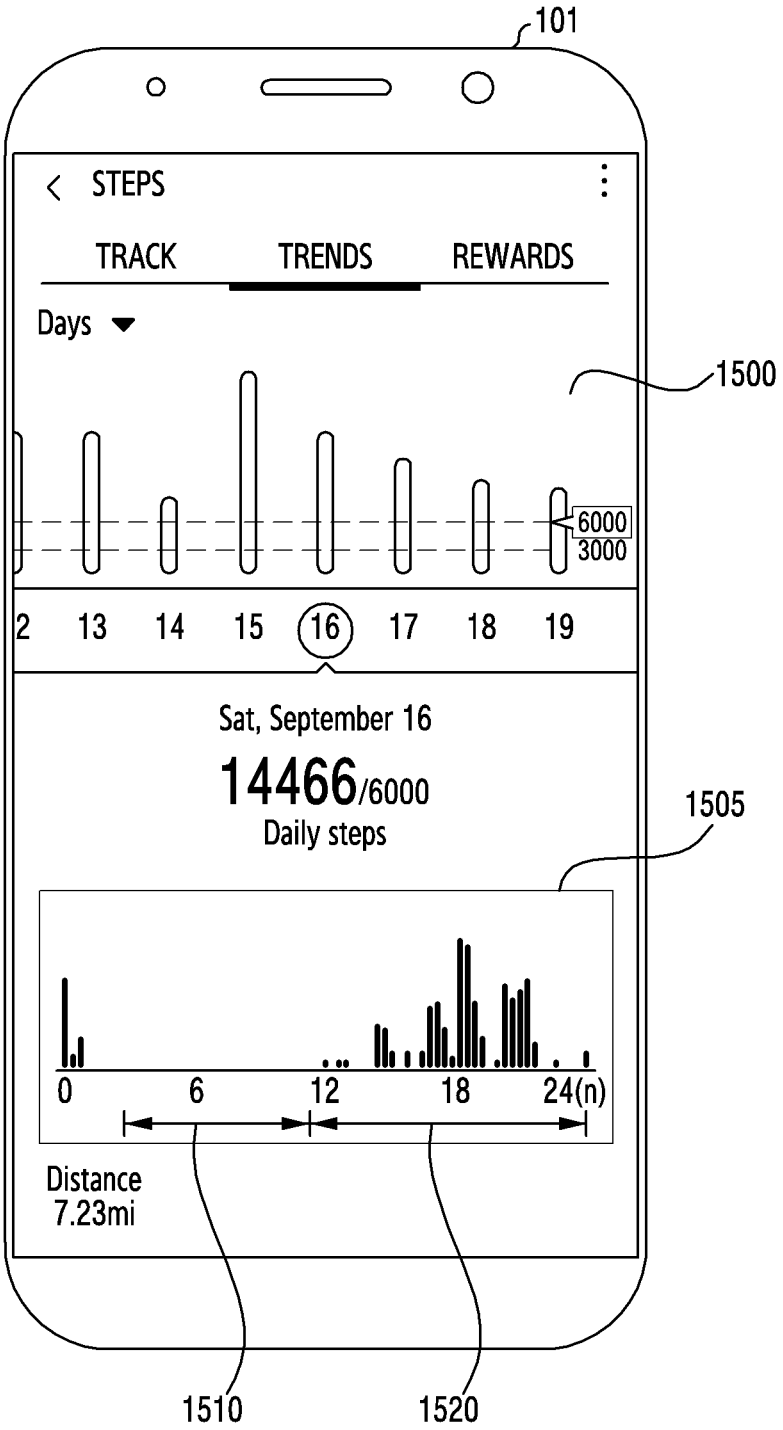
FIG. 15 is an illustration of a user interface (UI) displayed in an electronic devices according to an embodiment.

As such, the electronic device 102 according to an embodiment may obtain the current time information and thus associate various information with the current time information. By means of such association, the electronic device 102 may provide various services. FIG. 15 is an illustration of a UI displayed in an electronic devices according to an embodiment. Such a UI may be displayed at the electronic device 101 of FIG. 1 and FIG. 3.

Referring to FIG. 15, the electronic device 101 may display a UI 1500. The UI 1500 may be an application screen associated with biometric information. The UI 1500 may provide information associated with the biometric information. The UI 1500 may display information received from other electronic device such as the electronic device 102.

The UI 1500 may display biometric information 1505 which is received from the electronic device 102 and shows a user's steps associated with the electronic device 102. The biometric information 1505 may be measured on September $16^{th}$. The biometric information 1505 may include information regarding the user's steps during 24 hours. In a time interval 1510, the electronic device 102 may be mounted on the charger 310. The electronic device 102 may be worn by the user in the standalone state after hour 12. The electronic device 102 may obtain current time information through the operations of FIG. 4 through FIG. 13, and thus recognize time in the time interval 1520. For example, the electronic device 102, which recognizes the current time information, may recognize that a start point of the time interval 1520 is about hour 12 and an end point is about hour 24. The electronic device 102 may associate data indicating the user's steps of the biometric information 1505 with data regarding the time interval 1520 which may be derived from the current time information. The electronic device 102 may transmit to the electronic device 101 the data of the time interval 1520 associated with the data indicating the user steps. The electronic device 101 may display the biometric information 1505 in the UI 1500 based on the data of the time interval 1520 associated with the data indicating the user steps.

Figure 16:
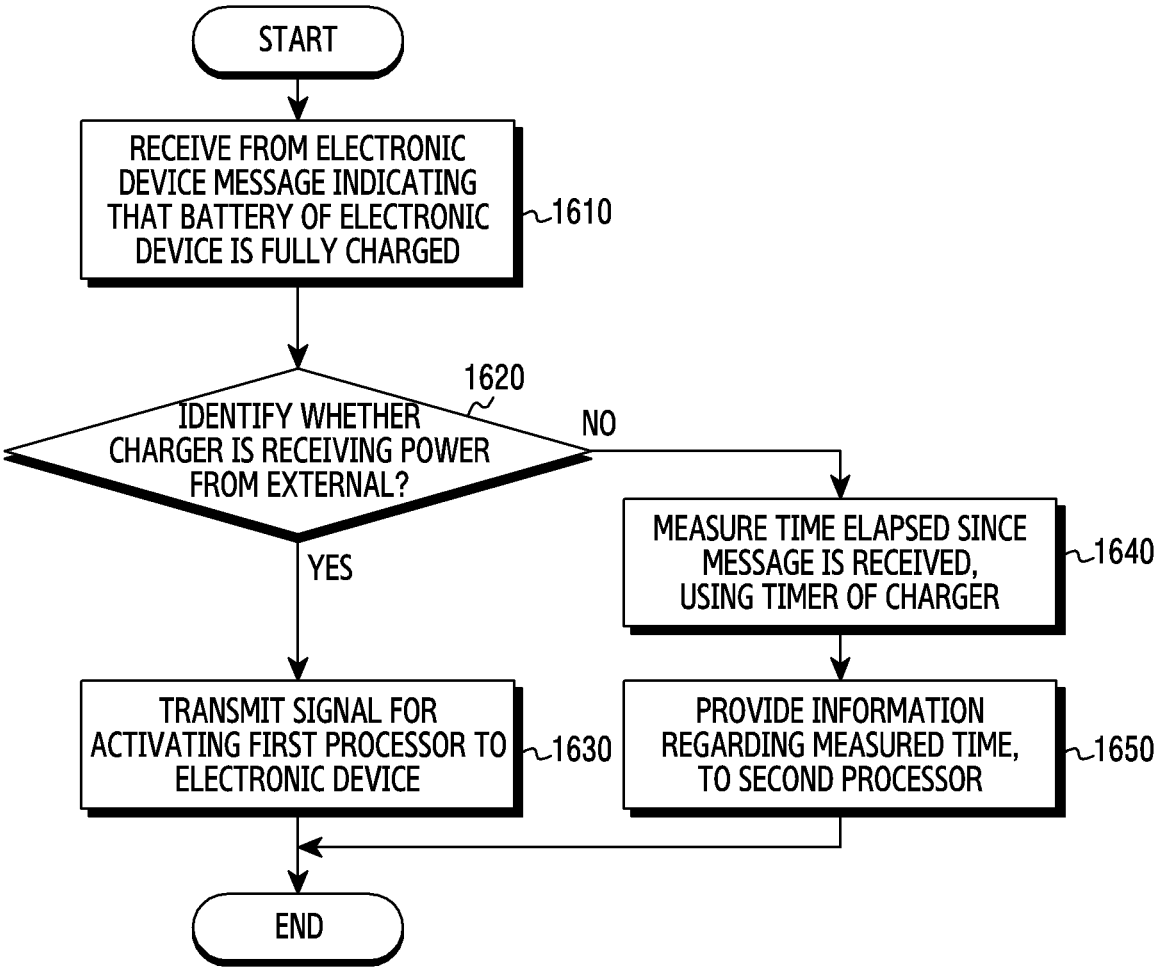
FIG. 16 is a flowchart of a method of a charger according to an embodiment.

FIG. 16 is a flowchart of a method of a charger according to an embodiment. Such operations may be fulfilled by the charger 310 or the processor 510 of the charger 310 of FIG. 5.

Referring to FIG. 16, in step 1610, the processor 510 may receive from the electronic device 102 a message indicating that the battery of the electronic device 102 is fully charged. In an embodiment, the processor 510 may receive the message indicating that the battery of the electronic device 102 is fully charged, from the electronic device 102 through the interface 550. The message may be transmitted from the second processor 420 of the electronic device 102. The message may be transmitted from the first processor 410 of the electronic device 102.

In step 1620, the processor 510 may identify whether the charger 310 is receiving power from an external. In an embodiment, in response to receiving the message, the processor 510 may identify whether the charger 310 is receiving the power from an external (or whether the charger 310 is connected to an external electronic device for providing the power to the electronic device 310). If it is identified that the charger 310 is receiving the power from an external, the processor 510 may preform step 1630. In contrast, if it is identified that the charger 310 is not receiving the power from an external, the processor 510 may preform step 1640.

If it is identified that the charger 310 is receiving the power externally, the processor 510 may transmit a signal for activating the first processor 410, to the electronic device 102 in step 1630. If the charger 310 is receiving the power from an external, the electronic device 102 may supplement the consumed power from the charger 310 after the full charge and, accordingly, the processor 510 may transmit to the electronic device 102 a signal for switching the first processor 410 to the active state. The first processor 410 may switch to the active state, based on receiving the signal for activating the first processor 410. The first processor 410 may switch the state of the timer 440 to the active state, based on the switch to the active state. Based on the active state switch of the timer 440, the first processor 410 may obtain information regarding time elapsed since the switch to the active state, from the timer 440.

The processor 510 may supplement the power consumed by the operations of the first processor 410 and the timer 440, by providing the power to the electronic device 102. In an embodiment, the processor 510 may provide the power to the electronic device 102, in order to maintain the full charge state of the battery.

If it is identified that the charger 310 is not receiving the power from an external, the processor 510 may measure the time elapsed since the message is received, using the timer 540 of the charger 310 in step 1640.

In step 1650, the processor 510 may provide information regarding the measured time, to the second processor 420. For example, the processor 510 may provide the measured time information to the second processor 420, based on a designated period. For example, in response to detecting that the cover of the charger 310 is opened, the processor 510 may provide the measured time information to the second processor 420. After providing the measured time information, the processor 510 may reset the measured time.

As above, a method of an electronic device according to an embodiment may include, if voltage of a battery of the electronic device falls within a first voltage range, refining, by a first processor of the electronic device, a first reference time using time information obtained from an external electronic device through communication circuitry of the electronic device, and if the voltage of the battery falls within a second voltage range, refining, at a second processor of the electronic device, a second reference time using the time information obtained from the external electronic device through the communication circuitry.

In an embodiment, the method may further include recording, by one of the first processor and the second processor, a user's biometric information associated with the electronic device based at least on the first reference time or the second reference time.

In an embodiment, refining the reference time of the first processor includes identifying, by the first processor, whether the voltage of the battery falls within the first voltage range, and, if the voltage of the battery falls within the first voltage range, refining, at the first processor, the first reference time based on information received from the time measurement circuitry or the time information.

In an embodiment, refining the reference time of the second processor may include identifying, by the first processor, whether the voltage of the battery falls within the second voltage range, if the voltage of the battery falls within the second voltage range, switching, by the first processor, a state of the second processor to an active state, and in response to switching the state of the second processor to the active state, refining, by the second processor, the second reference time using the time information. For example, refining the second reference time may include refining the second reference time using a clock frequency of the second processor and the time information.

For example, the method may further include, based on identifying that the voltage of the battery falls within the second voltage range, controlling, by the first processor, a PMIC of the electronic device to restrict voltage supplied to the first processor.

In an embodiment, the method may further include identifying, by the second processor, whether at least part of the other electronic device is contacted through the interface while refining the second reference time, transmitting, by the second processor, information regarding the refined second reference time, based on identifying that at least part of the other electronic device is contacted, and, after transmitting, switching, by the second processor, the state of the second processor to an inactive state. For example, the first processor operates in the inactive state while the second processor refines the second reference time, and switches from the inactive state to the active state in response to receiving information regarding the refined second reference time. The method may further include refining, by the first processor, the first reference time based at least on the information regarding the refined second reference time and the time information. For example, the method may further include, while obtaining the voltage from the other electronic device, identifying, by the first processor operating in the active state, whether the battery state is in a voltage range associated with full charge, and, if the battery state is in the voltage range associated with the full charge, transmitting, by the first processor, a signal for switching the state of the second processor to the active state, to the second processor and switching to the inactive state. The method may further include, in response to receiving the signal for switching the state of the second processor to the active state from the first processor, switching, by the second processor, the state of the second processor from the inactive state to the active state, and refining, by the second processor, the second reference time based at least on time information obtained from the other electronic device through the interface.

As such, a method of an electronic device according to an embodiment may include receiving, by a first processor of the electronic device, information associated with time, from an external electronic device, while remaining capacity of the battery is greater than or equal to a reference value, obtaining, by the first processor, first information associated with time that is elapsed since the information is received, by using a timer of the electronic device, and in response to identifying that the remaining capacity is less than the reference value, switching, by the first processor, a state of the second processor to an active state, obtaining, by a second processor of the electronic device, second information associated with time that is elapsed since the second processor is switched to the active state, and in response to detecting that the electronic device is connected to another electronic device for recharge of the battery, providing, by the second processor, the second information to the first processor.

In an embodiment, the method may further include, in response to identifying that the remaining capacity is less than the reference value, restricting, by the first processor, power provided to the first processor and the timer by using a power management integrated circuit of the electronic device. For example, the first processor or the timer may be switched to an inactive state based on the restriction of the power.

For example, the first processor or the timer may be switched from the inactive state to the active state in response to the detection, wherein the method may further include obtaining, by the first processor, the second information from the second processor, and obtaining, by the first processor, third information associated with time that is elapsed since the first processor is switched from the inactive state to the active state, and wherein the second processor may be switched to the inactive state based on the detection. For example, the method may further include switching, by the first processor, the second processor in the inactive state to the active state in response to identifying that the battery is fully charged, and obtaining, by the second processor, fourth information associated with time that is elapsed since the second processor is switched to the active state after the battery is fully charged.

For example, the method may further include, in response to the switching of the second processor after the battery is fully charged, requesting, by the second processor, information associated with time to the other electronic device, obtaining, by the second processor, fifth information associated with time that is elapsed since a signal is received from the other electronic device in response to the request, and refining, by the second processor, the fourth information, based on the fifth information. For example, the method may further include, in response to detecting that the connection between the other electronic device and the electronic device is released, providing, by the second processor, the refined fourth information to the first processor. For example, the method may further include obtaining, by the first processor, information associated with current time based on at least one of the first information, the second information, the third information, or the refined fourth information.

In an embodiment, the method may further include obtaining, by the first processor, information regarding the current time based at least on the first information or the second information, associating, by the first processor, biometric information obtained via at least one sensor of the electronic device with the current time, and storing, by the first processor, the biometric information that is associated with the current time.

In an embodiment, the method may further include, if an interrupt having a higher priority than obtaining the second information is caused, ceasing, by the second processor, obtaining the second information in order to process the interrupt, and restoring, by the second processor, the ceased obtaining in response to completing the interrupt processing.

As such, a method of an electronic device according to an embodiment may include receiving, via the interface from an external electronic device connected to the electronic device, a message for indicating that a battery of the external electronic device is fully charged, identifying whether the electronic device is obtaining power from an external, based on identifying that the electronic device is obtaining the power, transmitting a signal for activating a processor of the external electronic device that is associated with a timer of the external electronic device to the external electronic device, and based on identifying that the electronic device is not obtaining the power, measuring time by using a time measurement circuitry of the electronic device and transmitting information regarding the measured time to the external electronic device.

As set forth above, the electronic device and the method according to an embodiment may obtain the current time information independently from the state of the battery of the electronic device, by using the processor which operates with the lower power than the steady state power to control the time measurement.

The methods according to an embodiment described in the present disclosure may be implemented in software, hardware, or a combination of hardware and software.

If implemented in software, a non-transitory computer-readable storage medium storing one or more programs (software modules) may be provided. One or more programs stored in the non-transitory computer-readable storage medium may be configured for execution by one or more processors of an electronic device. One or more programs may include instructions for controlling the electronic device to execute the methods according to an embodiment of the present disclosure.

Such a program (software module, software) may be stored to a RAM, a non-volatile memory including a flash memory, a ROM, an EEPROM, a magnetic disc storage device, a compact disc (CD)-ROM, digital versatile discs (DVDs) or other optical storage devices, and a magnetic cassette. Alternatively, the program may be stored to a memory combining part or all of those recording media. In addition, a plurality of memories may be included.

Furthermore, the program may be stored in an attachable storage device accessible via a communication network such as the Internet, the Intranet, a LAN, a wide LAN (WLAN), a storage area network (SAN), or a communication network by combining these networks. The storage device may access the device which implements the embodiment of the present disclosure through an external port. In addition, a separate storage device may access the device which implements the embodiment of the present disclosure over the communication network.

In an embodiment of the present disclosure, the elements included in the disclosure are expressed in a singular or plural form according to the embodiment. However, the singular or plural expression is appropriately selected according to a proposed situation for the convenience of explanation, and the present disclosure is not intended to be limited to a single element or a plurality of elements, where the elements expressed in the plural form may be configured as a single element, and where the elements expressed in the singular form may be configured as a plurality of elements.

The electronic device according to various embodiments may be one of various types of electronic devices. The electronic devices may include, for example, a portable communication device (e.g., a smartphone), a computer, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the present disclosure to particular embodiments but include various changes, equivalents, or replacements for a corresponding embodiment.

With regard to the description of the accompanying drawings, similar reference numerals may be used to refer to similar or related elements. It is to be understood that a singular form of a noun corresponding to an item may include one or more of the item, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of, the items enumerated together in a corresponding one of the phrases. As used herein, such terms as "$1^{st}$," "$2^{nd}$," "first," and "second" may be used to simply distinguish a corresponding component from another component, but is not intended to limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it indicates that the element may be coupled with the other element directly (e.g., wiredly), wirelessly, or via a third element.

As used herein, the term "module" may include a unit implemented in hardware, software, or firmware, and may be used interchangeably with other terms, for example, "logic," "logic block," "part," or "circuitry". A module may be a single integral component, or a minimum unit or part thereof, adapted to perform one or more functions. For example, according to an embodiment, a module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor(e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. The term "non-transitory" indicates that the storage medium is a tangible device, but does not include a signal (e.g., an electromagnetic wave. However, this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a non-transitory machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the non-transitory machine-readable storage medium, such as memory of the manufacturer's server, a server of the application store, or a relay server.

According to various embodiments, each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by a module, a program, or another component may be carried out sequentially, in parallel, repeatedly, or heuristically, or one or more of the operations may be executed in a different order or omitted, or one or more other operations may be added.

In addition, the present disclosure discloses embodiments thereof, but various modifications may be made without departing from the scope of the present disclosure. Therefore, the scope of the present disclosure is not intended to be limited to the embodiments but is defined by the appended claims and their equivalents.

What is claimed is:

1. An electronic device, comprising:

a communication interface;

a battery configured to be rechargeable;

a timer;

a first processor operably coupled to the communication interface, the battery, and the timer; and a second processor operably coupled to the battery, wherein the first processor is configured to:

receive, from an external electronic device, information associated with time;

while remaining capacity of the battery is greater than or equal to a reference value, obtain, by using the timer, first information associated with time that is elapsed since the information is received; and in response to identifying that the remaining capacity is less than the reference value, switch a state of the second processor to an active state, and wherein the second processor is configured to:

obtain second information associated with time that is elapsed since the second processor is switched to the active state; and in response to detecting that the electronic device is connected to another electronic device for recharging the battery, provide the second information to the first processor.

2. The electronic device of claim 1, further comprising:

a power management integrated circuit, wherein the first processor is further configured to:

in response to identifying that the remaining capacity is less than the reference value, restrict, by using the power management integrated circuit, power provided to the first processor and the timer.

3. The electronic device of claim 2, wherein the first processor or the timer is switched to an inactive state based on the restriction of the power.

4. The electronic device of claim 3, wherein the first processor or the timer is switched from the inactive state to the active state in response to detecting that the electronic device is connected to another electronic device for recharging the battery, wherein the first processor is further configured to:

obtain the second information from the second processor; and obtain third information associated with time that is elapsed since the first processor is switched from the inactive state to the active state, and wherein the second processor is switched to the inactive state based on detecting that the electronic device is connected to another electronic device for recharging the battery.

5. The electronic device of claim 4, wherein the first processor is further configured to switch the second processor in the inactive state to the active state in response to identifying that the battery is fully charged, and wherein the second processor is configured to obtain fourth information associated with time that is elapsed since the second processor is switched to the active state after the battery is fully charged.

6. The electronic device of claim 5, wherein the second processor is configured to:

in response to the switching of the second processor after the battery is fully charged, request information associated with time from the other electronic device;

obtain fifth information associated with time that is elapsed since a signal is received from the other electronic device in response to the request; and refine the fourth information, based on the fifth information.

7. The electronic device of claim 6, wherein the second processor is further configured to:

in response to detecting that the connection between the other electronic device and the electronic device is released, provide the refined fourth information to the first processor.

8. The electronic device of claim 7, wherein the first processor is further configured to obtain information associated with current time based on at least one of the first information, the second information, the third information, or the refined fourth information.

9. The electronic device of claim 1, further comprising:

at least one sensor, wherein the first processor is further configured to:

obtain information regarding the current time based at least on the first information or the second information, associate biometric information obtained via the at least one sensor with the current time; and store the biometric information that is associated with the current time.

10. An electronic device, comprising:

an interface;

time measurement circuitry; and a processor operably coupled to the interface and the time measurement circuitry, wherein the processor is configured to:

receive, via the interface from an external electronic device connected to the electronic device, a message for indicating that a battery of the external electronic device is fully charged;

identify whether the electronic device is obtaining power externally;

based on identifying that the electronic device is obtaining the power, transmit a signal for activating a processor of the external electronic device that is associated with a timer of the external electronic device to the external electronic device; and based on identifying that the electronic device is not obtaining the power, measure time by using the time measurement circuitry and transmit information regarding the measured time to the external electronic device.

11. A method for operating an electronic device, the method comprising:

receiving, by a first processor of the electronic device, information associated with time, from an external electronic device;

while remaining capacity of the battery is greater than or equal to a reference value, obtaining, by the first processor, first information associated with time that is elapsed since the information is received, by using a timer of the electronic device; and in response to identifying that the remaining capacity is less than the reference value, switching, by the first processor, a state of the second processor to an active state;

obtaining, by a second processor of the electronic device, second information associated with time that is elapsed since the second processor is switched to the active state; and in response to detecting that the electronic device is connected to another electronic device for recharging the battery, providing, by the second processor, the second information to the first processor.

12. The method of claim 11, further comprising:

in response to identifying that the remaining capacity is less than the reference value, restricting, by the first processor, power provided to the first processor and the timer by using a power management integrated circuit of the electronic device.

13. The method of claim 12, wherein the first processor or the timer is switched to an inactive state based on the restriction of the power.

14. The method of claim 13, wherein the first processor or the timer is switched from the inactive state to the active state in response to detecting that the electronic device is connected to another electronic device for recharging the battery, wherein the method further comprises:

obtaining, by the first processor, the second information from the second processor; and obtaining, by the first processor, third information associated with time that is elapsed since the first processor is switched from the inactive state to the active state, and wherein the second processor is switched to the inactive state based on detecting that the electronic device is connected to another electronic device for recharging the battery.

15. The method of claim 14, further comprising:

switching, by the first processor, the second processor in the inactive state to the active state in response to identifying that the battery is fully charged; and obtaining, by the second processor, fourth information associated with time that is elapsed since the second processor is switched to the active state after the battery is fully charged.

16. The method of claim 15, further comprising:

in response to switching the second processor to the active state after the battery is fully charged, requesting, by the second processor, information associated with time to the other electronic device;

obtaining, by the second processor, fifth information associated with time that is elapsed since a signal is received from the other electronic device in response to the request; and refining, by the second processor, the fourth information, based on the fifth information.

17. The method of claim 16, further comprising:

in response to detecting that the connection between the other electronic device and the electronic device is released, providing, by the second processor, the refined fourth information to the first processor.

18. The method of claim 17, further comprising:

obtaining, by the first processor, information associated with current time based on at least one of the first information, the second information, the third information, or the refined fourth information.

19. The method of claim 11, further comprising:

obtain, by the first processor, information regarding the current time based at least on the first information or the second information, associating, by the first processor, biometric information obtained via at least one sensor of the electronic device with the current time; and storing, by the first processor, the biometric information that is associated with the current time.

20. A method for operating an electronic device, the method comprising:

receiving, via an interface from an external electronic device connected to the electronic device, a message for indicating that a battery of the external electronic device is fully charged;

identifying whether the electronic device is obtaining power externally;

based on identifying that the electronic device is obtaining the power, transmitting a signal for activating a processor of the external electronic device that is associated with a timer of the external electronic device to the external electronic device; and based on identifying that the electronic device is not obtaining the power, measuring time by using time measurement circuitry of the electronic device and transmitting information regarding the measured time to the external electronic device.

* * * * *